US009993683B2

(12) United States Patent
Moschel

(10) Patent No.: US 9,993,683 B2
(45) Date of Patent: Jun. 12, 2018

(54) UPPER BODY EXERCISE EQUIPMENT WITH LOWER BODY PEDALS AND METHODS OF USING THE SAME

(71) Applicant: Michael Moschel, Astoria, NY (US)

(72) Inventor: Michael Moschel, Astoria, NY (US)

( * ) Notice: Subject to any disclaimer, the term of this patent is extended or adjusted under 35 U.S.C. 154(b) by 0 days. days.

(21) Appl. No.: 14/104,664

(22) Filed: Dec. 12, 2013

(65) Prior Publication Data

US 2014/0364282 A1 Dec. 11, 2014

Related U.S. Application Data

(63) Continuation-in-part of application No. 13/967,945, filed on Aug. 15, 2013.
(Continued)

(51) Int. Cl.
*A63B 23/08* (2006.01)
*A63B 22/06* (2006.01)
(Continued)

(52) U.S. Cl.
CPC ..... *A63B 22/0605* (2013.01); *A63B 21/0628* (2015.10); *A63B 21/4031* (2015.10);
(Continued)

(58) Field of Classification Search
CPC ..... A63B 21/062; A63B 21/1492; A63B 21/1496; A63B 22/0012; A63B 22/0605; A63B 23/035; A63B 23/03516; A63B 23/03525; A63B 23/03533; A63B 23/1245; A63B 23/1254; A63B 23/1263; A63B 23/1272; A63B 23/1281; A63B 2022/0652; A63B 21/4033–21/4035; A63B 22/001
(Continued)

(56) References Cited

U.S. PATENT DOCUMENTS 2,209,034 A 7/1940 Paul
3,833,216 A 9/1974 Philbin
(Continued)

FOREIGN PATENT DOCUMENTS

CA 2630430 11/2009
KR 1020120070239 6/2012
WO 9700031 1/1997

OTHER PUBLICATIONS

U.S. Appl. No. 61/831,903, filed Jun. 6, 2013.
(Continued)

*Primary Examiner* — Gregory Winter

(57) ABSTRACT

A physical exercise apparatus according to an exemplary embodiment of the present disclosure includes a frame, a seat, a pair of movable arms, and a pair of cycling foot pedals. The seat may be supported by the frame and configured to support a user in an at least partially supine position. The pair of movable arms may be movably coupled to a first portion of the frame and coupled with a common, linearly movable resistance load. The first portion of the frame may be stationary with respect to the seat. The pair of cycling foot pedals may be movably coupled to a second portion of the frame and independently movable from the pair of movable arms so that the user can cycle the pair of cycling foot pedals while separately engaging the pair of movable arms.

11 Claims, 34 Drawing Sheets

Related U.S. Application Data

(60) Provisional application No. 61/831,903, filed on Jun. 6, 2013, provisional application No. 61/872,207, filed on Aug. 30, 2013.

(51) Int. Cl.

| | |
|---|---|
| ***A63B 22/00*** | (2006.01) |
| ***A63B 23/035*** | (2006.01) |
| ***A63B 23/12*** | (2006.01) |
| ***A63B 23/14*** | (2006.01) |
| ***A63B 21/062*** | (2006.01) |
| *A63B 21/00* | (2006.01) |

(52) U.S. Cl.
CPC ..... *A63B 21/4047* (2015.10); *A63B 21/4049* (2015.10); *A63B 22/0012* (2013.01); *A63B 23/03525* (2013.01); *A63B 23/03533* (2013.01); *A63B 23/1209* (2013.01); *A63B 23/14* (2013.01); *A63B 21/4035* (2015.10); *A63B 23/1254* (2013.01); *A63B 23/1272* (2013.01); *A63B 23/1281* (2013.01)

(58) Field of Classification Search
USPC ..... 482/51, 57–65, 92–103, 138
See application file for complete search history.

(56) References Cited

U.S. PATENT DOCUMENTS

| | | | | |
|---|---|---|---|---|
| 4,333,644 | A | 6/1982 | Lambert, Jr. et al. | |
| 4,625,962 | A | 12/1986 | Street | |
| 4,765,616 | A | 8/1988 | Wolff | |
| 4,830,362 | A | 5/1989 | Bull | |
| 4,838,547 | A | 6/1989 | Sterling | |
| 4,842,269 | A | 6/1989 | Huang | |
| D305,677 | S | 1/1990 | Beistegui | |
| D308,085 | S | 5/1990 | Alberta | |
| 4,974,839 | A | 12/1990 | Cantor | |
| 4,974,840 | A | 12/1990 | Welch | |
| 5,108,092 | A | 4/1992 | Hurst | |
| 5,145,479 | A | 9/1992 | Olschansky et al. | |
| 5,178,593 | A | 1/1993 | Roberts | |
| D342,299 | S | 12/1993 | Birrell et al. | |
| D346,878 | S | 5/1994 | Gee et al. | |
| 5,318,487 | A | 6/1994 | Golen et al. | |
| 5,405,305 | A | 4/1995 | Wilkinson et al. | |
| 5,496,236 | A | 3/1996 | Buonauito | |
| D372,283 | S | 7/1996 | Chen | |
| 5,569,128 | A | 10/1996 | Dalebout | |
| 5,580,341 | A * | 12/1996 | Simonson | 482/100 |
| 5,823,921 | A | 10/1998 | Dawson | |
| 5,941,803 | A | 8/1999 | Chamberlain et al. | |
| 5,971,898 | A | 10/1999 | Schoolfield | |
| 5,976,062 | A | 11/1999 | Toups | |
| 6,071,216 | A * | 6/2000 | Giannelli | A63B 21/159 482/100 |
| D427,652 | S | 7/2000 | Webber | |
| 6,090,021 | A | 7/2000 | Flowers et al. | |
| 6,254,516 | B1 * | 7/2001 | Giannelli | A63B 23/1209 482/100 |
| 6,413,192 | B2 | 7/2002 | Abelbeck | |
| D462,730 | S | 9/2002 | Cormier | |
| 6,478,127 | B2 | 11/2002 | Fukushima | |
| 6,547,702 | B1 | 4/2003 | Heidecke | |
| 6,551,219 | B1 | 4/2003 | Brown | |
| 6,565,495 | B2 | 5/2003 | Slattery | |
| 6,902,515 | B2 | 6/2005 | Howell et al. | |
| D526,368 | S | 8/2006 | Giger et al. | |
| D531,237 | S | 10/2006 | Giger et al. | |
| 7,285,077 | B1 | 10/2007 | Marx | |
| 7,322,907 | B2 | 1/2008 | Bowser | |
| 7,513,853 | B1 | 4/2009 | Russ | |
| 7,524,272 | B2 | 4/2009 | Bruck et al. | |
| 7,662,070 | B1 | 2/2010 | Mann | |
| 7,695,411 | B2 | 4/2010 | Pandozy | |
| 7,717,833 | B1 | 5/2010 | Nelson et al. | |
| 7,740,563 | B2 | 6/2010 | Dalebout et al. | |
| 7,775,936 | B2 | 8/2010 | Wilkinson | |
| 7,874,971 | B2 | 1/2011 | Reyes | |
| D637,245 | S | 5/2011 | Huber et al. | |
| 7,985,167 | B2 | 7/2011 | Nizam | |
| 8,206,272 | B2 | 6/2012 | Greene | |
| 8,388,504 | B2 | 3/2013 | Ellis | |
| 8,523,743 | B1 | 9/2013 | Miles et al. | |
| D697,565 | S | 1/2014 | Giger et al. | |
| 8,821,354 | B1 | 9/2014 | Tabahi | |
| D727,444 | S | 4/2015 | Dixon | |
| 9,079,067 | B2 | 7/2015 | Huber et al. | |
| 9,545,540 | B1 * | 1/2017 | Moschel | A63B 22/0046 |
| 9,878,201 | B1 * | 1/2018 | Moschel | A63B 22/0605 |
| 2002/0035017 | A1 * | 3/2002 | Pertegaz-Esteban | 482/92 |
| 2002/0052268 | A1 * | 5/2002 | Morcillo-Quintero | A63B 23/0211 482/92 |
| 2004/0192522 | A1 | 9/2004 | Hippensteel | |
| 2005/0096196 | A1 | 5/2005 | Webber et al. | |
| 2005/0101463 | A1 * | 5/2005 | Chen | 482/142 |
| 2005/0277524 | A1 | 12/2005 | Bae | |
| 2006/0019804 | A1 | 1/2006 | Young | |
| 2006/0063650 | A1 | 3/2006 | Francis | |
| 2006/0116253 | A1 | 6/2006 | Nizam | |
| 2006/0264304 | A1 | 11/2006 | Habing | |
| 2007/0173384 | A1 | 7/2007 | Sechrest et al. | |
| 2008/0051274 | A1 | 2/2008 | Greene | |
| 2008/0318738 | A1 | 12/2008 | Chen | |
| 2009/0286658 | A1 | 11/2009 | James | |
| 2010/0035729 | A1 * | 2/2010 | Pandozy | 482/9 |
| 2010/0210425 | A1 | 8/2010 | Bowser | |
| 2011/0172064 | A1 | 7/2011 | Cutler et al. | |
| 2011/0245043 | A1 | 10/2011 | Mitchell | |
| 2014/0031173 | A1 | 1/2014 | Huang | |
| 2014/0031174 | A1 | 1/2014 | Huang | |
| 2014/0287883 | A1 | 9/2014 | Decca | |
| 2014/0364281 | A1 * | 12/2014 | Moschel | 482/80 |
| 2014/0364284 | A1 * | 12/2014 | Moschel | 482/97 |
| 2014/0364285 | A1 * | 12/2014 | Moschel | 482/98 |

OTHER PUBLICATIONS

U.S. Appl. No. 61/872,207, filed Aug. 30, 2013.
Utility U.S. Appl. No. 13/967,945, filed Aug. 15, 2013.
Photograph of prior art exercise machine accessed on Dec. 5, 2013 from URL. https://encrypted-tbn2.gstatic.com/images?q=tbn:ANd9GcSIIvDYh7Y4av62BDNf61YHLvSaxArhi2MxY3KgGmallS1UeuqXba.
Photograph of prior art exercise machine. Accessed from World Wide Web on Sep. 20, 2013.
Declaration of Michael Moschel under 37 C.F.R. 1.132, filed in U.S. Appl. No. 14/104,664 on Dec. 30,2015.
Declaration of Michael Moschel under 37 C.F.R. 1.132, filed in U.S. Appl. No. 14/154,957 on Feb. 8, 2016.
Declaration of Michael Moschel under 37 C.F.R. 1.132 filed in U.S. Appl. No. 14/961,134 on Aug. 22, 2016.
Recumbent Bike Intervals + Arm Training, <https://www.youtube.com/watch?v=Z5_PqnKmcs4>, Nov. 2, 2010.
Sky presscycle by symmetry central dated no date given, Found online [Nov. 8, 2016] http://www.symmetrycentral.com/.
Declaration of Michael Moschel under 37 C.F.R. 1.132, filed in U.S. Appl. No. 13/967,945 on Oct. 5, 2015.

* cited by examiner

UPPER BODY EXERCISE EQUIPMENT WITH LOWER BODY PEDALS AND METHODS OF USING THE SAME

CROSS-REFERENCE TO RELATED APPLICATIONS

This application claims the benefit of and priority to each of U.S. Provisional Patent Application No. 61/831,903, filed on Jun. 6, 2013, U.S. patent application Ser. No. 13/967,945, filed on Aug. 15, 2013, and U.S. Provisional Patent Application No. 61/872,207, filed on Aug. 30, 2013, the entire contents of each of which are incorporated by reference herein.

FIELD

The present invention generally relates to physical exercise equipment and methods of using the same, and in particular, to physical exercise equipment that includes an upper body exercise and a separate, independent, repetitive lower body exercise. In embodiments, the repetitive lower body exercise may position a user in a manner so that the user can use physical exercise equipment to inhibit, improve, and/or correct muscular imbalances.

SUMMARY

A physical exercise apparatus according to an exemplary embodiment of the present disclosure comprises a frame, a seat, a pair of movable arms, and a pair of cycling foot pedals. The seat is supported by the frame and configured to support a user in an at least partially supine position. The pair of movable arms is movably coupled to a first portion of the frame and coupled with a common, linearly movable resistance load. The first portion of the frame is stationary with respect to the seat. The pair of cycling foot pedals is movably coupled to a second portion of the frame and independently movable from the pair of movable arms so that the user can cycle the pair of cycling foot pedals while separately engaging the pair of movable arms.

In exemplary embodiments, the pair of movable arms is configured to be pushed laterally outwardly with respect to the seat.

In exemplary embodiments, the pair of movable arms is configured to be pulled downwardly with respect to the seat.

In exemplary embodiment, the pair of movable arms is configured to be lifted upwardly with respect to the seat.

In exemplary embodiments, the pair of movable arms is configured to be pulled laterally inwardly with respect to the seat.

In exemplary embodiments, the pair of movable arms is configured to be rotated about a rotation axis that is coextensive with the pair of movable arms and stationary with respect to the seat.

In exemplary embodiments, the pair of movable arms is configured to be pulled downwardly and laterally outwardly with respect to the seat.

In exemplary embodiments, the pair of movable arms is configured to converge with respect to an axial midline of the user's body.

In exemplary embodiments, the pair of movable arms is configured to diverge with respect to an axial midline of the user's body.

In exemplary embodiments, the pair of movable arms is configured to provide resistance to a portion of a user's upper body.

In exemplary embodiments, the pair of cycling foot pedals is configured to provide distraction to a portion of a user's lower body.

In an exemplary embodiment of the present disclosure, a method of physical exercise training comprises providing a physical exercise apparatus. The physical exercise apparatus comprises a frame, a seat, a pair of movable arms, and a pair of cycling foot pedals. The seat is supported by the frame. The pair of movable arms is movably coupled to a first portion of the frame and coupled with a common, linearly movable resistance load. The first portion of the frame is stationary with respect to the seat. The pair of cycling foot pedals is movably coupled to a second portion of the frame and independently movable from the pair of movable arms. The method also comprises positioning at least a portion of a body of a user in an at least partially supine position on the seat; accessing by the user the pair of movable arms with the user in the at least partially supine position; simultaneously engaging by the user the pair of movable arms to exercise a portion of an anatomy of the user and independently cycling by the user the pair of cycling foot pedals using a pair of feet of the user while the user is in the at least partially supine position. The independent cycling by the user of the pair of cycling foot pedals positions and/or maintains the user's position so that the moving by the user of the pair of movable arms inhibits, improves, and/or corrects muscular imbalances.

In exemplary embodiments, engaging by the user the pair of movable arms includes pushing the pair of movable arms laterally outwardly with respect to the seat.

In exemplary embodiments, engaging by the user the pair of movable arms includes pulling the pair of movable arms downwardly with respect to the seat.

In exemplary embodiments, engaging by the user the pair of movable arms includes lifting the pair of movable arms upwardly with respect to the seat.

In exemplary embodiments, engaging by the user the pair of movable arms includes pulling the pair of movable arms laterally inwardly with respect to the seat.

In exemplary embodiments, engaging by the user the pair of movable arms includes rotating the pair of movable arms about a rotation axis that is coextensive with the pair of movable arms and stationary with respect to the seat.

In exemplary embodiments, engaging by the user the pair of movable arms includes downwardly and laterally outwardly with respect to the seat.

BRIEF DESCRIPTION OF THE DRAWINGS

Various exemplary embodiments of this invention will be described in detail, with reference to the following figures, wherein.

DETAILED DESCRIPTION

Figure 1A:
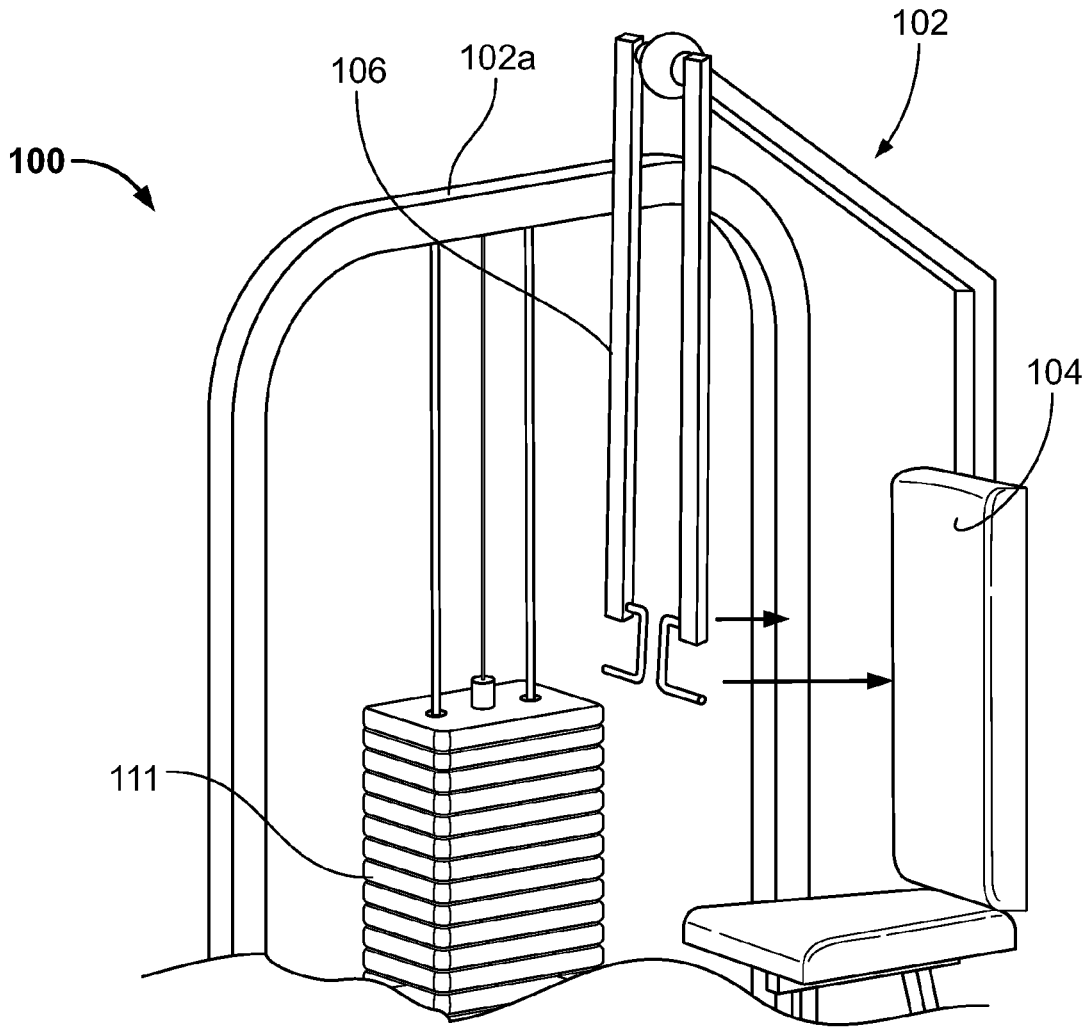
FIG. 1A is a perspective view of a physical exercise apparatus according to an exemplary embodiment of the present disclosure.

The present invention is generally directed towards physical exercise apparatuses and associated methods of use. The present invention generally relates to a physical exercise apparatus and/or method of using the same comprising an upper body target exercise portion and a lower body distraction exercise portion, wherein the target exercise portion and the distraction exercise portion are substantially biomechanically isolated and independently movable from each other, and wherein such movement may position and/or maintain a user's position with respect to the physical exercise apparatus to inhibit, improve, and/or correct muscular imbalances.

The disclosed exercise equipment apparatuses may be configured to provide a distracting exercise to distract a portion of a user's body. In embodiments, a distracting exercise may be configured to generate neuromuscular signals, work, load, and/or otherwise engage a portion of the user's body. In embodiments, a portion of a user's upper body may be targeted for resistance training. In embodiments, a portion of a user's lower body may be a distracted portion of the user's body. In embodiments, a distracted portion of a user's body may be a portion of the user's body that is not targeted for resistance training.

In embodiments, a distracting exercise may incorporate substantial resistance, such as a strength training exercise. In embodiments, a distracting exercise may provide primarily or exclusively strength training, for example, a distracting exercise may provide substantially little or no cardiovascular training. In embodiments, a distracting exercise may comprise a cycling motion of at least a portion of a user's lower body, and may include flexion and/or extension of the user's leg at the knee. In embodiments, distraction of one portion of a user's body may facilitate the engagement of deep muscles, ligaments and/or tendons of a target portion of the user's body. Such deep muscles, ligaments, and/or tendons may be located within a portion of a user's body at positions deeper below the user's skin than muscles, ligaments, and/or tendons that are typically engaged by a resistance exercise that does not incorporate a distracting exercise.

In embodiments, the disclosed physical exercise apparatuses may provide a user with a configuration of movement and/or positioning that may provide therapeutic benefits for a user, such as maintaining, improving, and/or correcting posture, improving and/or correcting muscular imbalances, maintaining and/or improving a user's flexibility and/or strength, rehabilitation of injuries, and/or generally facilitating health and/or healing. In embodiments, a user's posture may include the user's resting and/or at least partially active biomechanical alignment.

In embodiments, distraction of one portion of the user's body may position the user in a manner so that it is substantially difficult or impossible to achieve an improper position during performance of the target exercise. In embodiments, a distracting exercise may position a user such that it may be substantially difficult for a user to leverage a non-target portion of the user's body against a target muscle portion of the user's body in performing a resistance exercise, maintain an improper posture, and/or apply an asymmetrical resistive loading to a target muscle group.

In embodiments, the distraction of one portion of the user's body may tend to position at least a portion of the user's body in a manner such that the user is discouraged from favoring and/or leveraging one portion of a target muscle group against another portion of the target muscle group so that a target muscle group may receive an increased resistive loading as compared to a positioning of the user's body without a distracting exercise. In embodiments, the distraction of one portion of the user's body may tend to position a user in such a manner that a user receives a substantially even resistive loading with respect to an axial midline of the user's body across target muscle groups.

In embodiments, the distraction of one portion of the user's body may position the user in a manner so that the user is inhibited from developing neuromuscular adaptations so that the user may be inhibited from, for example, adapting, becoming bored with, and/or reaching a training plateau with respect to the target exercise.

FIG. 1A shows a physical exercise equipment apparatus, generally designated by reference number 100, according to an exemplary embodiment of the present disclosure. Exercise equipment apparatus 100 may include a frame 102 having a first portion 102*a*. A seat 104 may be supported by frame 102 and configured to support a user in an at least partially supine position. In embodiments described herein, a user in an at least partially supine position may be in a seated and/or at least partially reclined position. A pair of independently movable arms 106 may be movably coupled to the first portion 102*a* of the frame 102. In embodiments described herein, a movably coupled arm may be pivotably or hingably coupled to a frame, to name a few. The first portion 102*a* of the frame 102 may be substantially stationary with respect to seat 104 so that each movable arm 106 may be movably coupled to a respective substantially stationary coupling point on the frame 102. The pair of movable arms 106 may be coupled with a common, linearly movable resistance load 111. In embodiments, resistance load 111 may be an adjustable weight stack. In embodiments, the pair of movable arms 106 may include a gripping member, such as handles, for engagement by a user. The pair of movable arms 106 may be configured to be pulled downwardly and/or laterally outwardly with respect to the seat 104 so that a user can perform, for example, lat pulls, with the pair of movable arms 106.

Figure 1B:
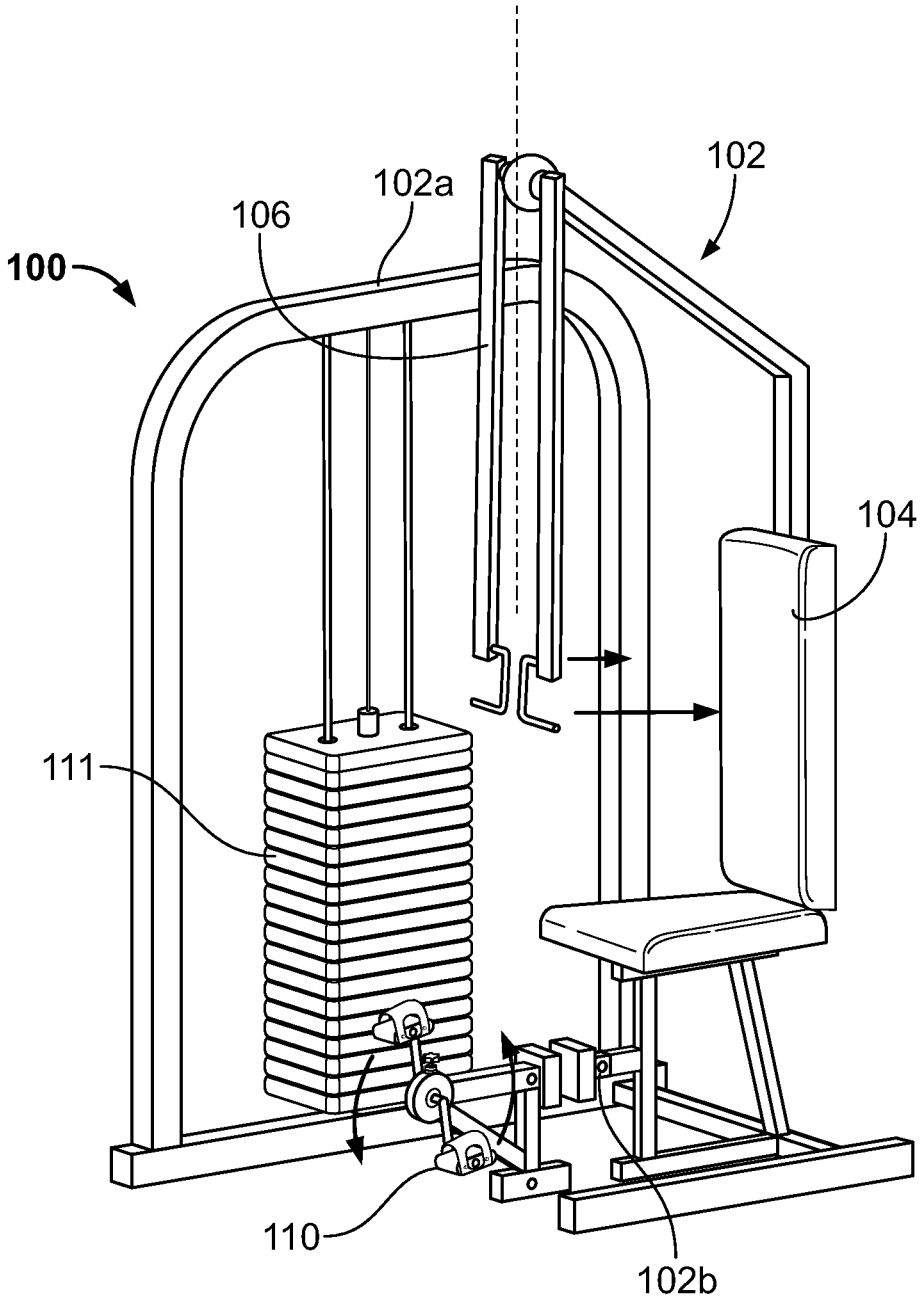
FIG. 1B is a perspective view of a physical exercise apparatus according to an exemplary embodiment of the present disclosure.

Turning to FIG. 1B, in an exemplary embodiment exercise equipment apparatus 100 may further comprise a pair of cycling foot pedals 110 may be coupled to a second portion 102*b* of the frame 102 and independently movable from the pair of movable arms 106 so that the user can cycle the pair of cycling foot pedals 110 while separately moving the pair of movable arms 106 to perform, for example, lat pulls. In embodiments described herein, a user may engage one or more movable arms by moving the one or more movable arms. The second portion 102*b* of the frame 102 may be substantially stationary with respect to seat 104 so that the cycling foot pedals 110 are rotatably coupled to the frame 102 and movable about a substantially stationary rotation axis. The pair of cycling foot pedals 110 may be positioned in front of the seat 104 and configured for engagement by a portion of a user's lower body.

As shown, the cycling foot pedals 110 may be separable from the frame 102 of exercise equipment apparatus 100. The pair of cycling foot pedals 110 may be releasably coupled with the second portion 102*b* of frame 102 of physical exercise apparatus 100. The pair of cycling foot pedals 110 may be coupled with the frame 102 in any suitable manner, such as welding, soldering, fastening with bolts or screws, straps, or interlocking features, to name a few.

In embodiments, the pair of cycling foot pedals 110 may be provided as a separate component from frame 102. In such embodiments, a user may couple the pair of cycling foot pedals 110 with the second portion 102*b* of frame 102 before using physical exercise apparatus 100. In embodiments, the pair of cycling foot pedals 110 may be initially provided in a coupled configuration with the second portion 102*b* of frame 102, and may be separated from and/or reconnected to frame 102 thereafter at a user's discretion. In embodiments, foot pedals 110 may be integrally formed with the remainder of exercise equipment apparatus 100. In embodiments described herein, a pre-existing physical exercise apparatus may be modified with replacement and/or supplemental components as described above with respect to physical exercise apparatus 100. In this manner, a pre-existing physical exercise apparatus may be retrofitted or otherwise reconfigured after an initial manufacture to include, for example, a pair of cycling foot pedals.

The pair of cycling foot pedals 110 may be adjustable with respect to the seat 104 so that the pair of cycling foot pedals 110 may be positioned relative to the seat 104 to accommodate a user's height and/or reach. The frame 102 may also include complementary structure to the pair of cycling foot pedals 110, such as an axle, gear train, or the like. In embodiments, the pair of cycling foot pedals 110 may include an independent frame to support the pair of cycling foot pedals 110.

Figure 1C:
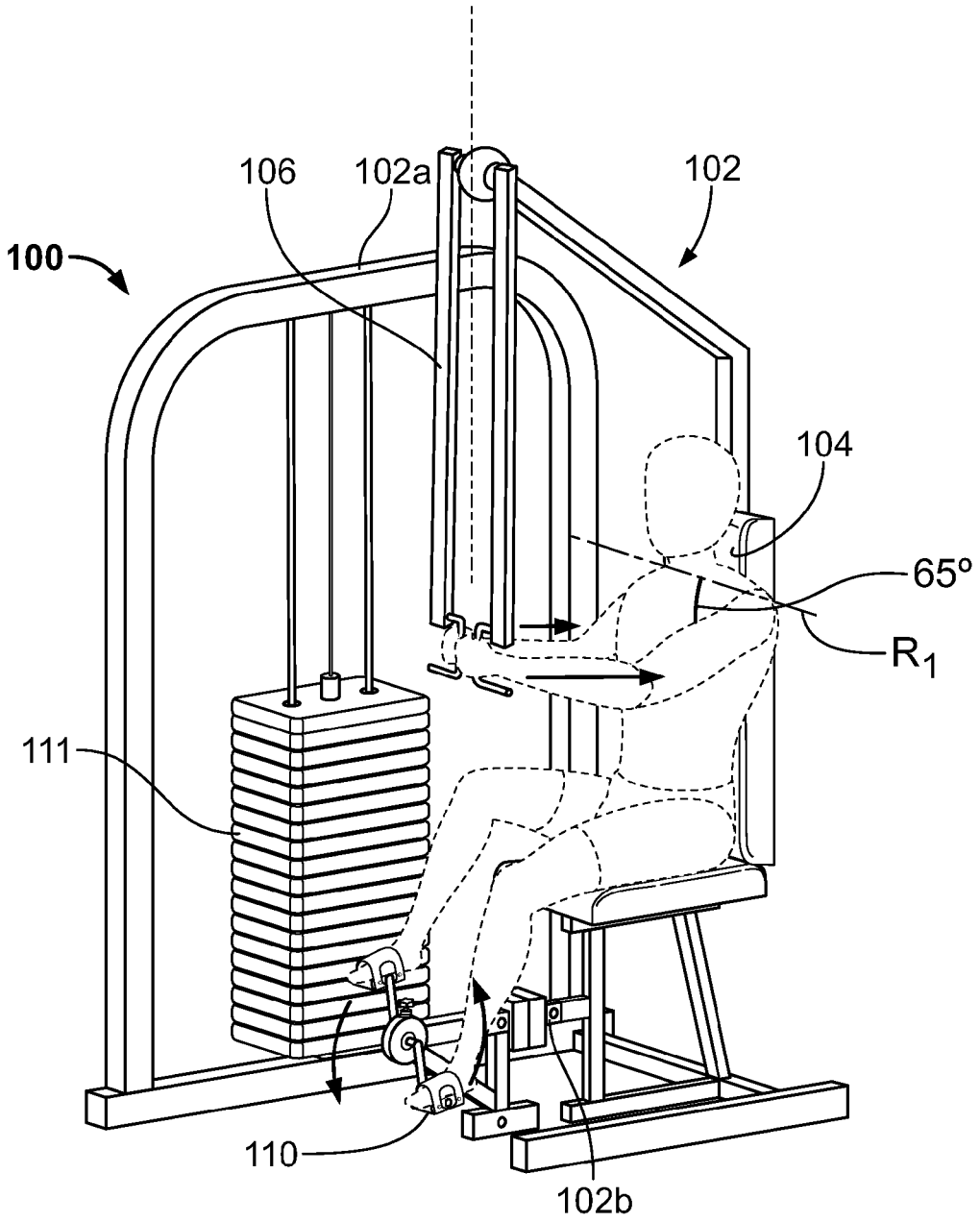
FIG. 1C is a perspective view of the physical exercise apparatus shown in FIG. 1B, with a user disposed therein.

With reference to FIG. 1C, a method of using the physical exercise apparatus 100 may comprise providing the physical exercise apparatus 100 and positioning at least a portion of a body of a user in an at least partially supine position on the seat 104. The user may access the pair of movable arms 106 with the user in the at least partially supine position. In embodiments described herein, a user may access a movable arm or other component of a physical exercise apparatus by grasping at least a portion of the movable arm. The user may place his or her feet on the pair of cycling foot pedals 110 in the at least partially supine position. In embodiments, the user may be positioned so that his or her arms are initially disposed so that at an angle of between and including about 60 degrees and about 70 degrees, for example, 65 degrees, is formed between the humerus and a reference line $R_1$ formed by the user's clavicle. In embodiments, a user may be positioned such that his or her arms are initially disposed so that a different angle is formed between the humerus and the reference line $R_1$.

Figure 1D:
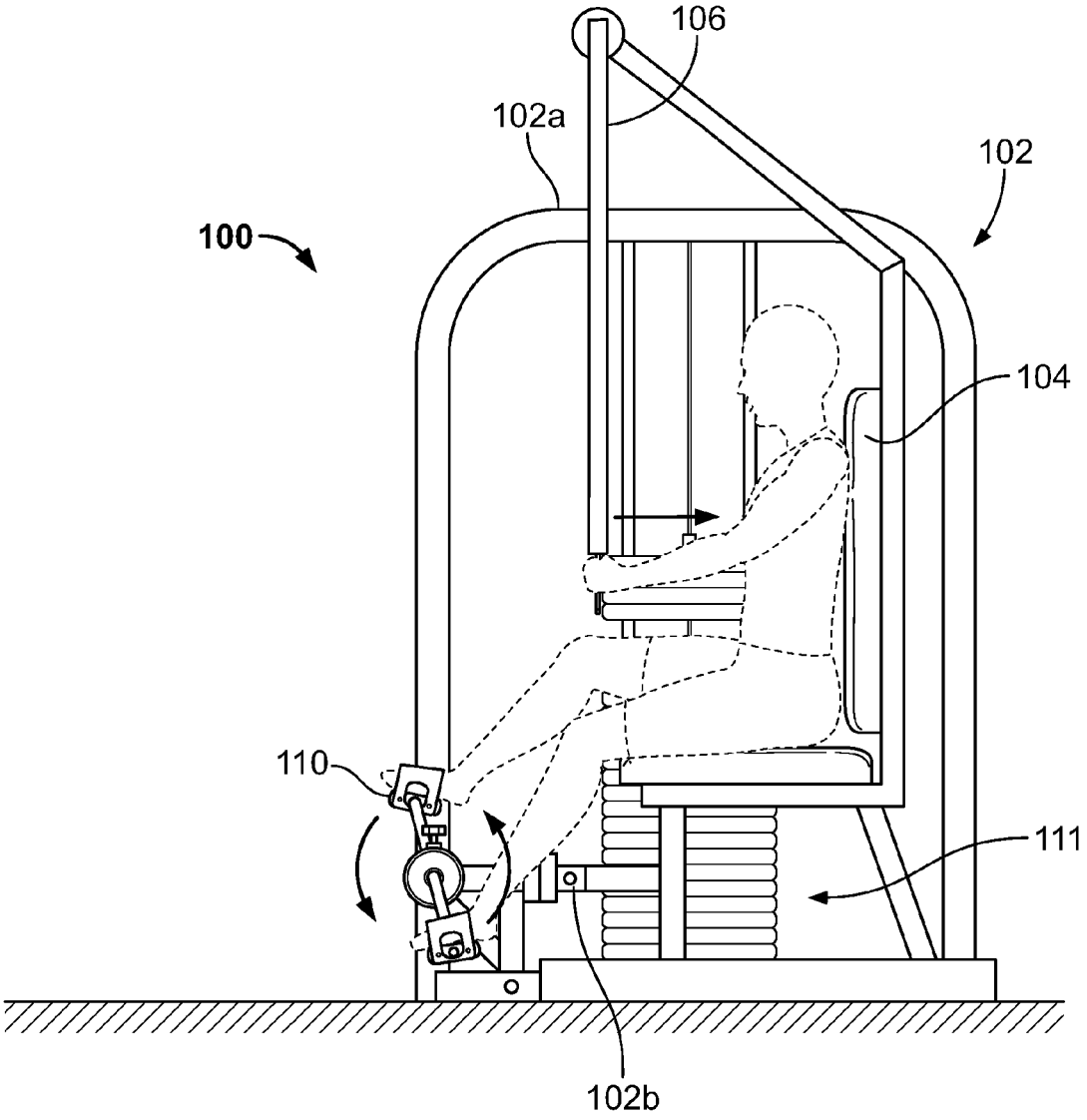
FIG. 1D is a side view of the physical exercise apparatus shown in FIG. 1B being operated by a user.

With reference to FIG. 1D, the user may simultaneously move the pair of movable arms 106 and independently cycle the pair of cycling foot pedals 110 with his or her feet while in the at least partially supine position. In embodiments, the user may continuously cycle the pair of cycling foot pedals 110 during use of the pair of movable arms 106.

The user may move the pair of movable arms 106 by pulling downwardly and/or radially outwardly with respect to the seat 104. In this manner, the user may perform lat pulls with the movable arms 106 so that resistance is provided, for example, to the latissimus dorsi muscles and/or other portions of the user's upper body. Movable arms 106 may move along respective oblique, linear paths so that movable arms 106 converge and diverge with respect to an axial midline of the user's body during use of physical exercise apparatus 100.

Figure 1E:
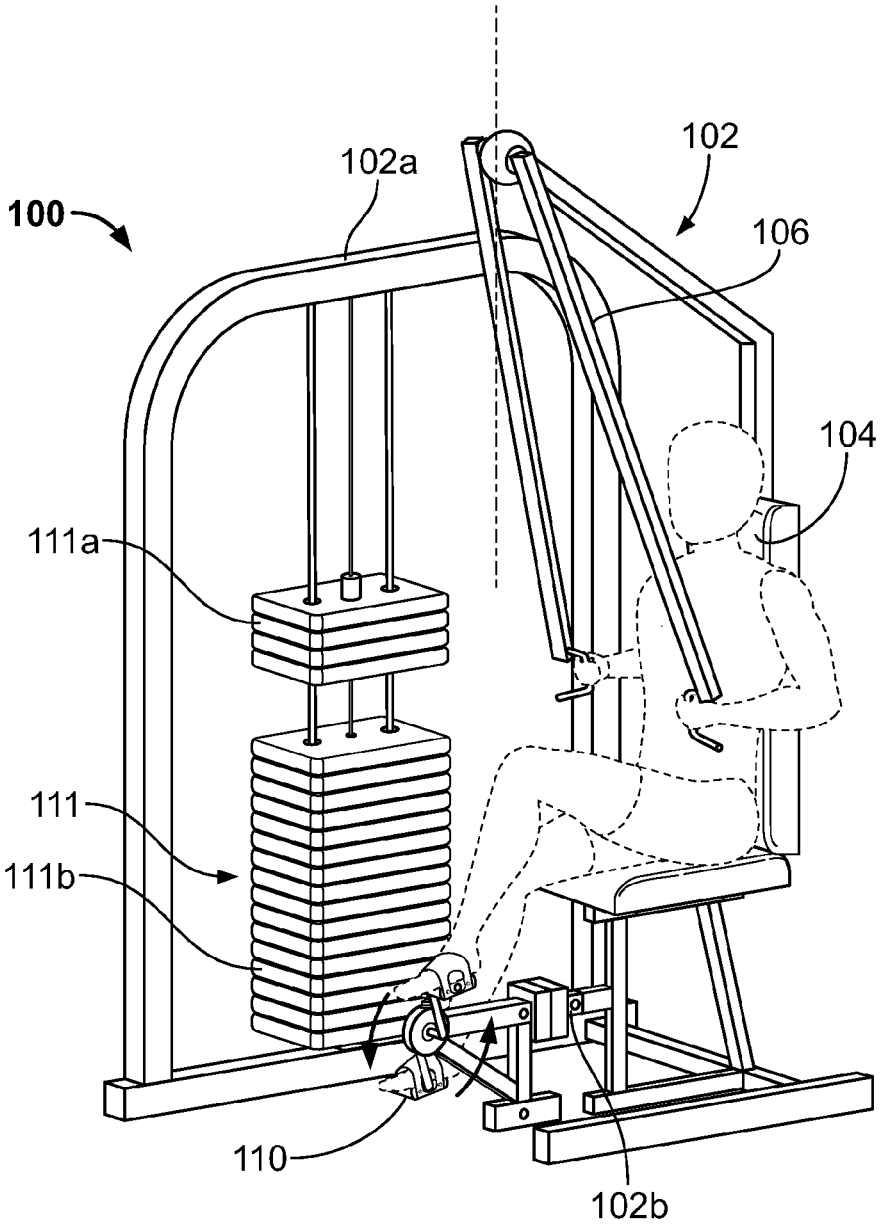
FIG. 1E is a perspective view of the physical exercise apparatus shown in FIG. 1B being operated by a user.
Figure 1F:
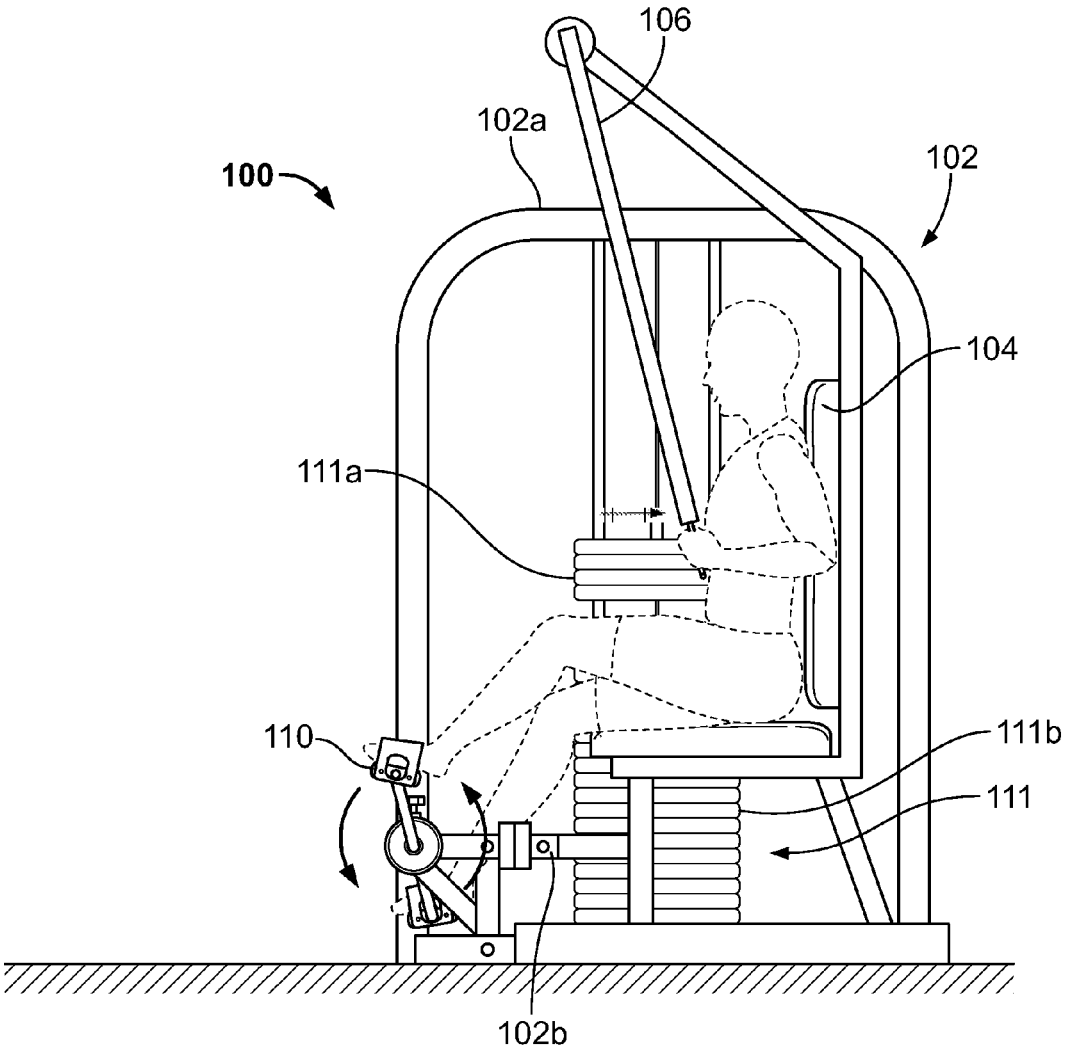
FIG. 1F is a side view of the physical exercise apparatus shown in FIG. 1E.

Referring to FIGS. 1E and 1F, the user's arms at the end of pulling the pair of movable arms 106 may have a position behind a user at an angle of between and including about −35 degrees and −45 degrees, such as −40 degrees, formed between the user's humerus and the reference line $R_1$ formed by the user's clavicle. In embodiments, the user's arms may be disposed at another angle formed between the user's humerus and the reference line $R_1$ after pulling the pair of movable arms 106.

In embodiments, the user may be positioned throughout the use of exercise equipment apparatus 100 such that an angle of between and including about 45 degrees and about 55 degrees, such as 50 degrees, is formed between the user's humerus and a reference line parallel to the front part of the user's thorax at the level of the diaphragm. In embodiments, a user may be positioned such that the user's arms are disposed so that a different angle is formed between the user's humerus and such a reference line throughout the use of exercise equipment apparatus 100.

The cycling motion of the user's lower body may provide distraction so that the user is positioned in a manner to perform lat pulls with the pair of movable arms 106 so that a substantially even resistive loading is received by, for example, the user's latissimus dorsi muscles. In this manner, a resistive loading may be transferred to the user's latissimus dorsi muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

In embodiments, the distraction of the lower body caused by the cycling motion of a user's lower body may substantially biomechanically isolate muscles of the lower body so that increased loading is experienced by target muscle groups. In such embodiments, target muscle groups may include the latissimus dorsi muscles. In this manner, a user may be inhibited from twisting, jerking, and/or shifting when using the physical exercise apparatus 100 using muscles of the lower body of the user to leverage muscles of the upper body in performing lat pulls with the pair of movable arms 106.

Figure 2A:
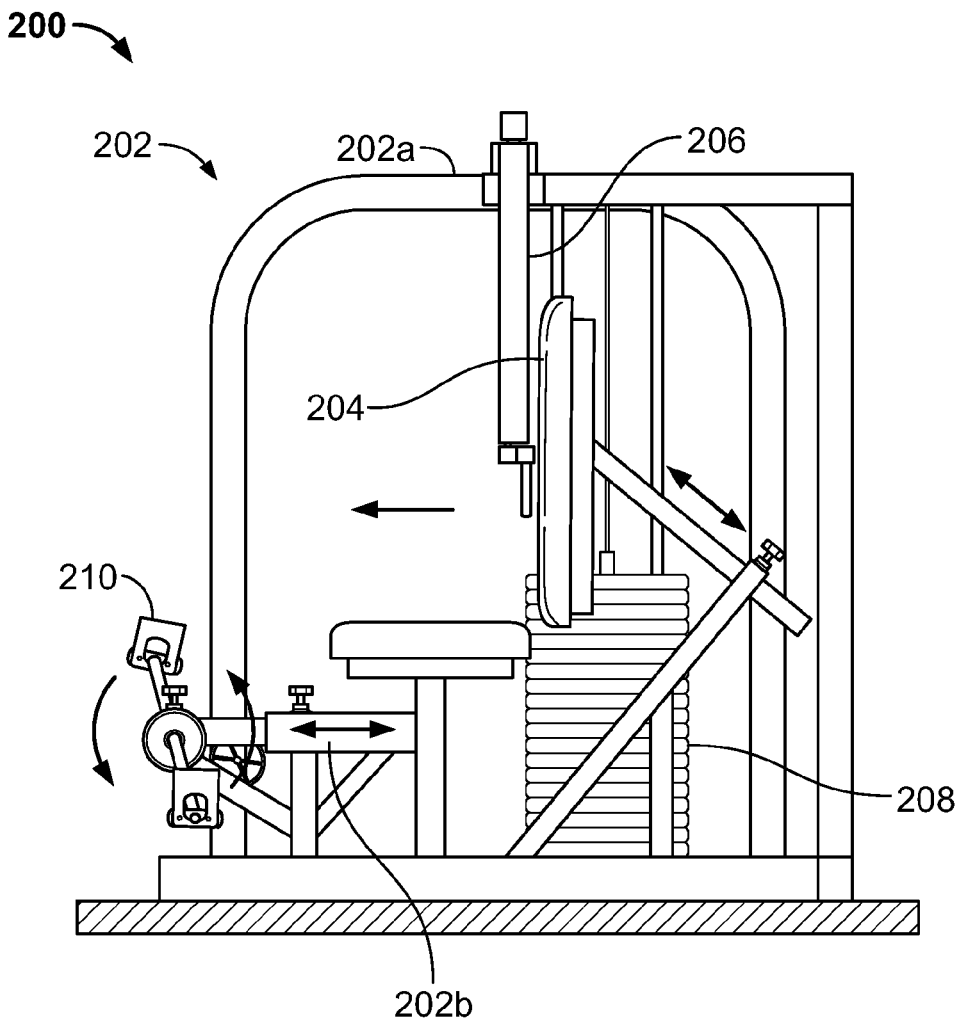
FIG. 2A is a side view of a physical exercise apparatus according to an exemplary embodiment of the present disclosure.

FIG. 2A shows a physical exercise apparatus, generally designated by reference number 200, according to an exemplary embodiment of the present disclosure. Physical exercise apparatus 200 may include a frame 202 having a first portion 202*a* and a second portion 202*b*. A seat 204 may be supported by the frame 202 and configured to support a user in an at least partially supine position.

A pair of independently movable arms 206 may be movably coupled to the first portion 202*a* of the frame 202. The pair of movable arms 206 may be configured to be pressed away from the seat 204 so that the user can perform, for example, chest presses with the pair of movable arms 206. The first portion 202*a* of the frame 202 may be substantially stationary with respect to the seat 204 so that the pair of movable arms 206 may be movably coupled to a substantially stationary coupling point on the frame 202. The pair of movable arms 206 may be coupled with a linearly movable resistance load 208. In embodiments, resistance load 208 may be an adjustable weight stack. The pair of movable arms 206 may be adjustable through a range of resting positions to be engaged by a user, for example, with the user's shoulder blades slightly pulled back.

A pair of cycling foot pedals 210 may be coupled to the second portion 202*b* of frame 202 and independently movable from the pair of movable arms 210 so that the user can cycle the pair of cycling foot pedals 210 while separately moving the pair of arms 206 to perform chest presses. The second portion 202*b* of the frame 202 may be substantially stationary with respect to the seat 204 so that the cycling foot pedals 210 may be rotatably attached to the frame 202 and movable about a substantially stationary rotation axis. The pair of cycling foot pedals 210 may be positioned in front of the seat 204 and configured for engagement by a portion of a user's lower body.

Figure 2B:
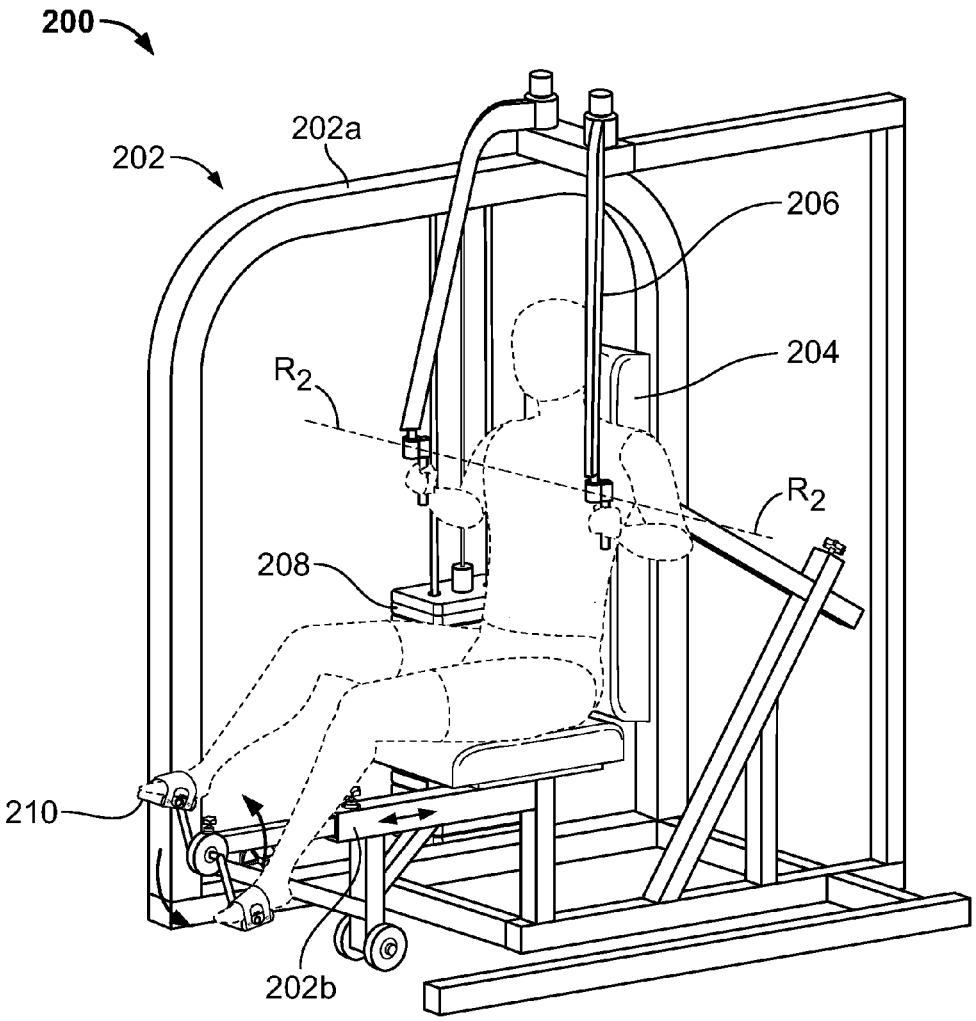
FIG. 2B is a perspective view of the physical exercise apparatus of FIG. 2A, with a user disposed thereon.

Referring to FIG. 2B, a method of physical exercise training may comprise providing the physical exercise apparatus 200 and positioning at least a portion of a body of a user in an at least partially supine position on the seat 204. The user may access the pair of movable arms 206 with the user in the at least partially supine position. The user may place his or her feet on the cycling foot pedals 210 with the user in the at least partially supine position. In embodiments, a user may access a portion of the movable arms 206 such that the user's arms are disposed to form an angle of between and including about −15 degrees and about −25 degrees, for example, −20 degrees, between the user's humerus and a reference line $R_2$ parallel to the user's clavicle in an at least partially supine position. In embodiments, the user may access the pair of movable arms 206 in a starting position with the user's arms positioned to form another angle between the user's humerus and the reference line $R_2$.

Figure 2C:
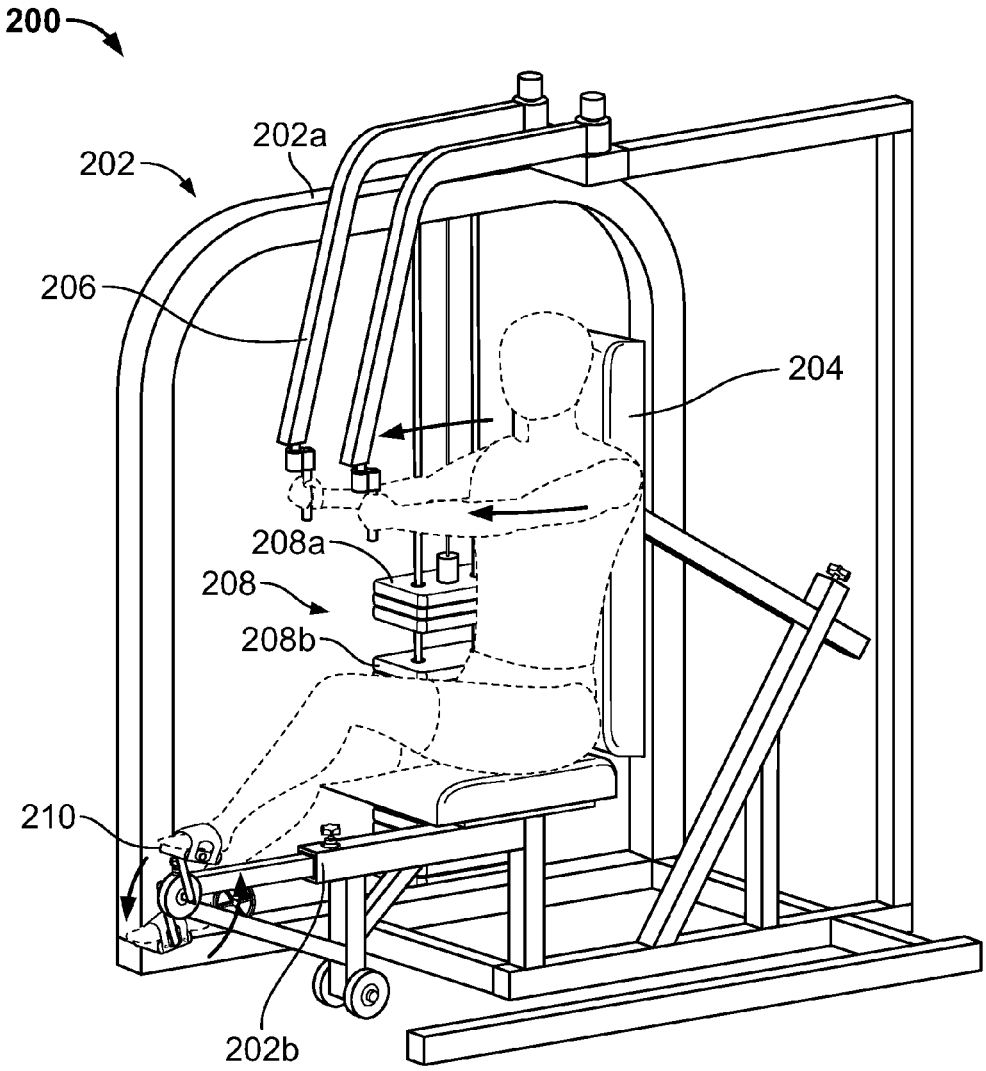
FIG. 2C is a perspective view of the physical exercise apparatus of FIG. 2A, being operated by a user.

With reference to FIG. 2C, the user may simultaneously move the movable arms 206 while independently cycling the cycling foot pedals 210 with the user in the at least partially supine position. In embodiments, the user may continuously cycle the pair of cycling foot pedals 210 during movement of the pair of movable arms 206. In embodiments, the user may move the pair of movable arms 206 so that the pair of movable arms 206 are pressed away from the user's mid-chest to a location frontally spaced away from the user and the seat 204. Movable arms 206 may move along respective oblique, linear paths so that movable arms 206 converge and diverge with respect to an axial midline of the user's body during use of physical exercise apparatus 200.

In embodiments, the user may extend his or her arms so that his or her arms have an extended position such that at an angle of between and including about 60 degrees and about 70 degrees, such as 65 degrees, is formed between the user's humerus and the reference line $R_2$ with the user in the at least partially supine position. Pressing of the movable arms 206 by the user may cause a selected portion 208*a* of the resistance load 208 to linearly move along the frame 202. An unselected portion 208*b* of the resistance load 208 may remain stationary along the frame 202. In embodiments, a selected portion 208*a* of the resistance load 208 may comprise the entire resistance load 208.

In embodiments, a user may be positioned throughout the use of exercise equipment apparatus 200 so that his or her respective humerus and radius are disposed at an angle of between and including about 85 degrees and about 95 degrees, such as 90 degrees, with respect to each other with the user's hands facing each other. In embodiments, a user may be positioned throughout the use of exercise equipment apparatus 200 such that another angle is formed between the user's humerus and radius. In embodiments, a user may be positioned throughout the use of exercise equipment apparatus so that an angle of between and including about 85 degrees and about 95 degrees, such as, 90 degrees, is formed between the user's humerus and a lateral part of the user's $7^{th}$ and/or $8^{th}$ rib. In embodiments, the user may be positioned throughout the use of exercise equipment apparatus 200 such that another angle is formed between the user's humerus and a lateral part of the user's $7^{th}$ and/or $8^{th}$ rib.

The cycling motion of the user's lower body may provide distraction so that the user is positioned in a manner to perform chest presses with the pair of movable arms 206 so that a substantially even resistive loading is received by, for example, the user's pectoralis muscles. In this manner, a resistive loading may be transferred to the user's pectoralis muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

Figure 3A:
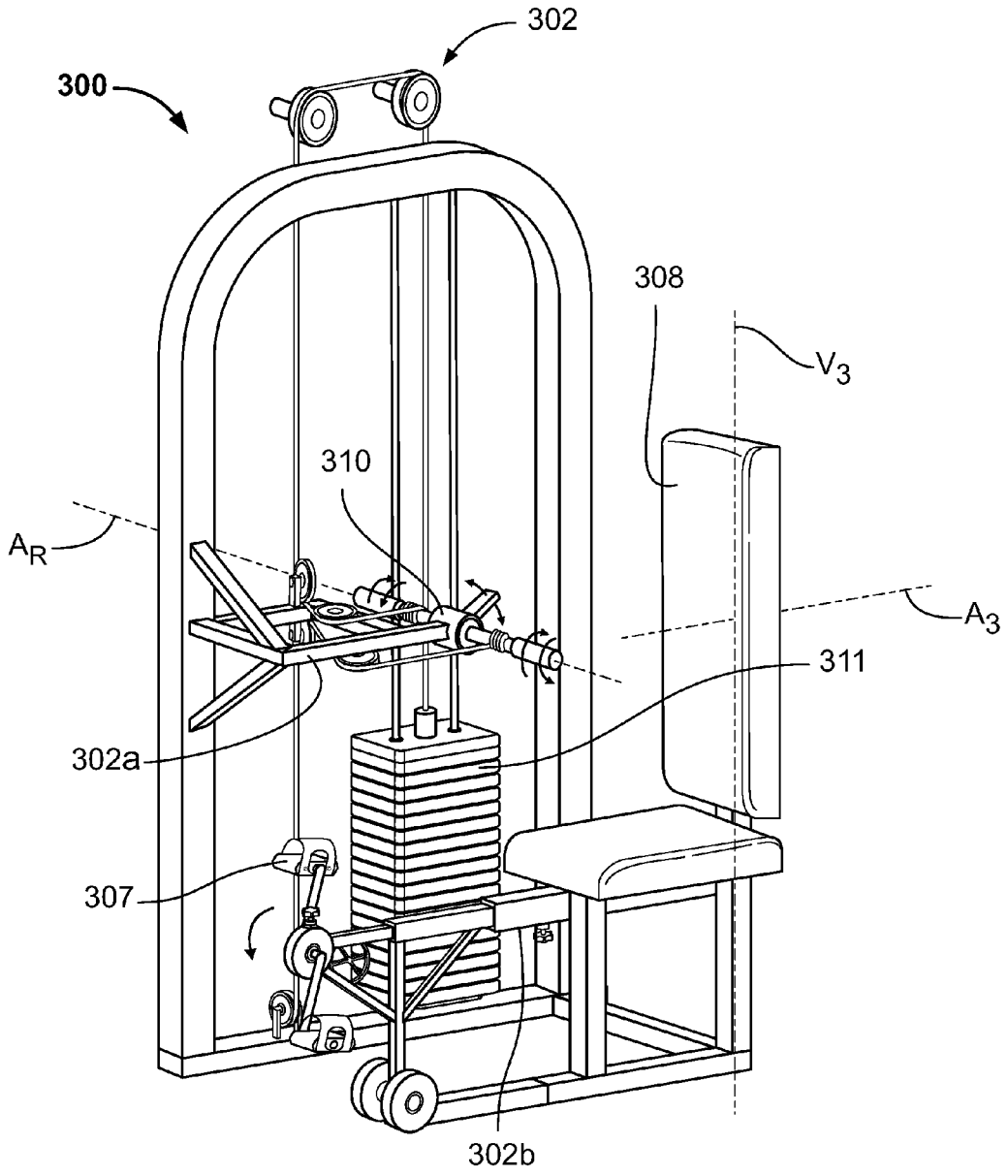
FIG. 3A is a perspective view of a physical exercise apparatus according to an exemplary embodiment of the present disclosure.

FIG. 3A shows a physical exercise apparatus, generally designated by reference number 300, according to an exemplary embodiment of the present disclosure. Physical exercise apparatus 300 may include a frame 302 having a first portion 302*a* and a second portion 302*b*. A seat 308 may be supported by the frame 302 and configured to support a user in an at least partially supine position. A pair of independently movable arms 310 may be symmetrically arranged about an axial midline $A_3$ of the seat 308. Movable arms 310 may have the form of, for example, bars or handles. In embodiments, the movable arms 310 may be symmetrically aligned about a vertical midline $V_3$ of the seat 308. Movable arms 310 may be movably coupled the first portion 302*a* of the frame 302 so that the movable arms 310 may be configured to turn, twist, rotate and/or spin about a substantially stationary rotation axis $A_R$ that is coextensive with the movable arms 310 and stationary with respect to the seat 308. In this manner, movable arms 310 may be configured so that a user can grasp and rotate the movable arms 310 in an overhand or underhand manner to provide a torsional resistive loading to the muscles of a user's forearms, for example, forearm flexors and/or extensors.

The first portion 302*a* of frame 302 may be substantially stationary with respect to seat 308 so that each of the movable arms 310 may be coupled to the frame 302 at a respective substantially stationary coupling point. Movable arms 310 may be coupled to a linearly movable resistance load 311. In embodiments, movable arms 310 may be coupled to resistance load 311 by one or more cables and/or pulleys. In embodiments, resistance load 311 may be an adjustable weight stack or free weight.

A load selector 312 may be attached to a portion of the frame 302 and configured so that movable arms 310 can be rotated about rotation axis $A_R$ in opposing directions while causing at least a portion of resistance load 311 to move in a constant direction along frame 302. In this manner, load selector 312 is configured so that a user can selectively raise or lower at least a portion of resistance load 311 while exerting opposing rotational forces on respective movable arms 310. Load selector 312 may have the form of, for example, a clutch, gearing, and/or ratcheting mechanism so that multiple rotational input forces of varying directions exerted on movable arms 310 are transferred into a linear force of a single direction on at least a portion of resistance load 311. Load selector 312 may incorporate a one-way stop so that at least a portion of resistance load 311 can be incrementally moved along frame 302 without returning to its resting condition between successive movements of movable arms 310. In embodiments, physical exercise apparatus 300 may incorporate multiple load selectors 312 for multiple respective independent resistance loads.

A pair of cycling foot pedals 307 may be coupled to the second portion 302*b* of frame 302 and independently movable from the movable arms 310 so that the user can cycle the pair of cycling foot pedals 307 while separately rotating the movable arms 310 about the rotation axis $A_R$. The second portion 302*b* of the frame 302 may be substantially stationary with respect to the seat 308 so that the cycling foot pedals 307 may be rotatably attached to the frame 302 and movable about a substantially stationary rotation axis. The pair of cycling foot pedals 307 may be positioned in front of the seat 308 and configured for engagement by a portion of a user's lower body.

Figure 3B:
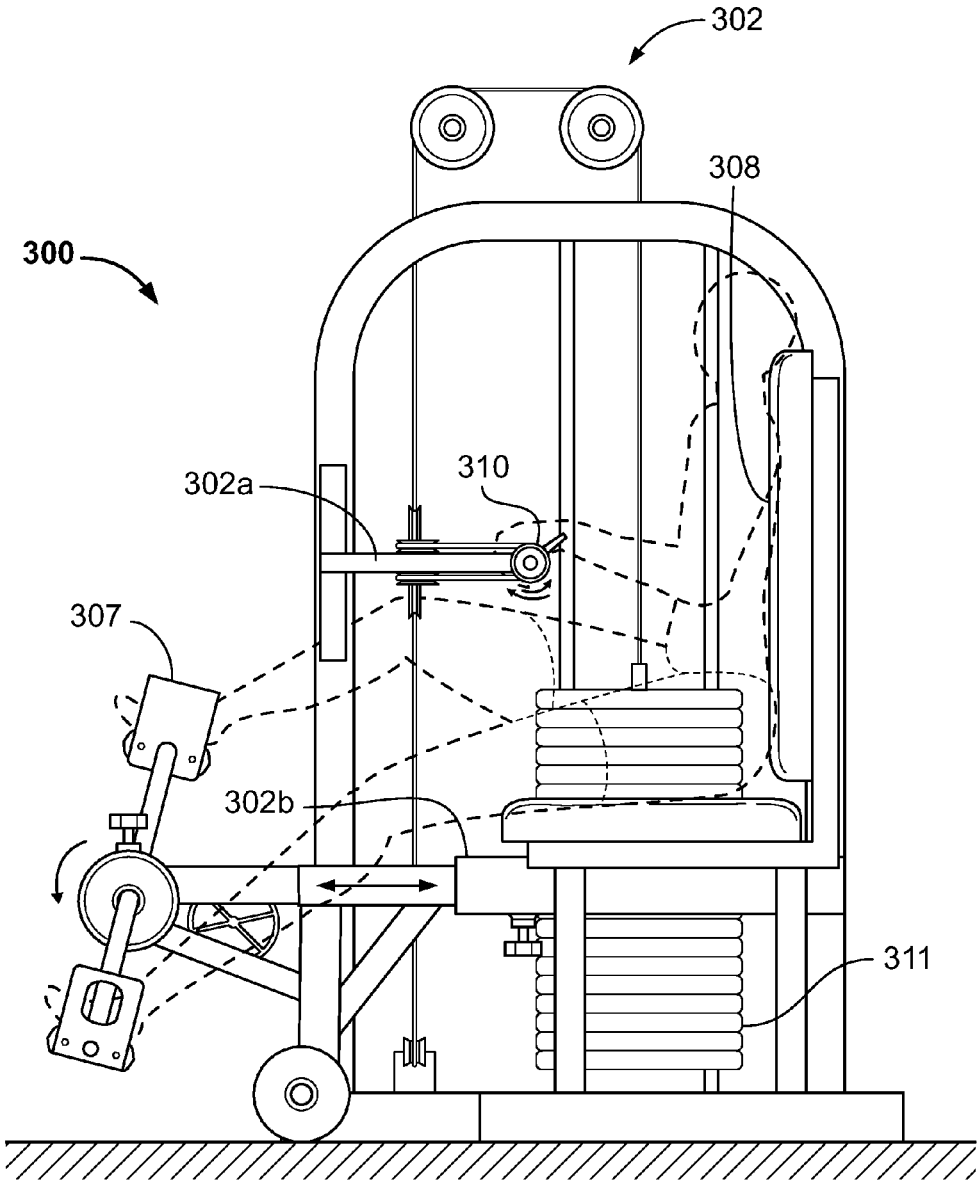
FIG. 3B is a side view of the physical exercise apparatus of FIG. 3A, with a user disposed thereon.

Referring to FIG. 3B, a method of physical exercise training may comprise providing the physical exercise apparatus 300 and positioning at least a portion of the body of a user in an at least partially supine position on the seat 308. The user may access the movable arms 310 while in the at least partially supine position. The user may place his or her feet on the pair of cycling foot pedals 307 while in the at least partially supine position.

Figure 3C:
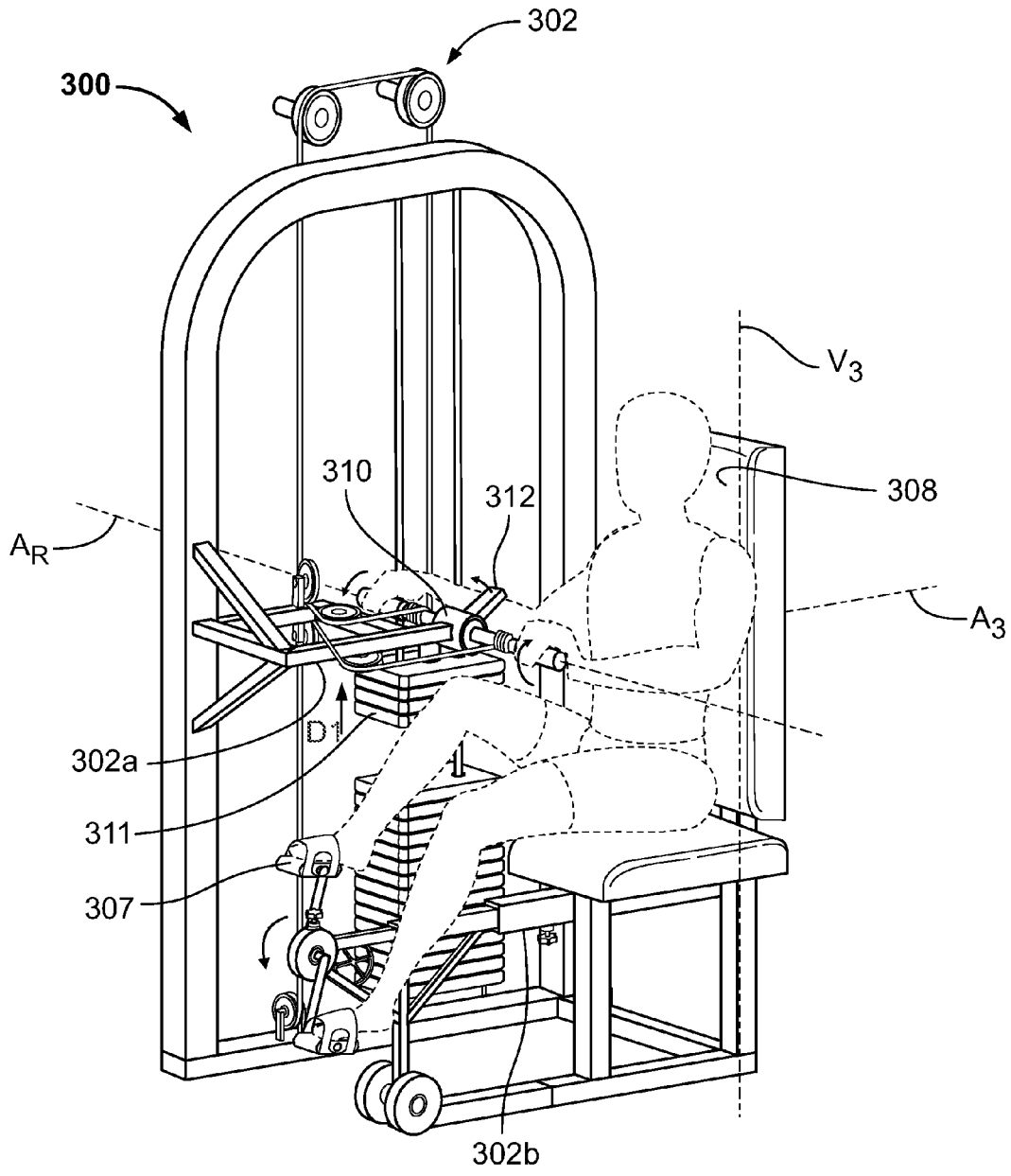
FIG. 3C is a first sequential perspective view of the physical exercise apparatus of FIG. 3A, being operated by a user.

With reference to FIG. 3C, the user may simultaneously move the movable arms 310 by rotating the movable arm 310 about the rotation axis $A_R$ (FIG. 3A) in an overhand or underhand manner, and independently cycle the pair of cycling foot pedals 307 with the user in the at least partially supine position. In embodiments, the user may continuously cycle the pair of cycling foot pedals 307 during movement of the pair of movable arms 310. In embodiments, the user may turn, twist, rotate and/or spin the movable arms 310 so that the resistance load 311 is linearly moved, via one or more cables and/or pulleys, by the movement of the movable arms 310. Rotation of the movable arms 310 by the user may cause a selected portion 311*a* of the resistance load 311 to linearly move along the frame 302. An unselected portion 311*b* of the resistance load 311 may remain stationary along the frame 302. In embodiments, a selected portion 311*a* of the resistance load 311 may comprise the entire resistance load 311.

The cycling motion of the user's lower body may provide distraction so that the user is positioned in a manner to perform forearm exercises with the pair of movable arms 310 so that a substantially even resistive loading is received by, for example, the user's forearm flexors and/or extensors. In this manner, a resistive loading may be transferred to the user's forearm flexors and/or extensors that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

Figure 3D:
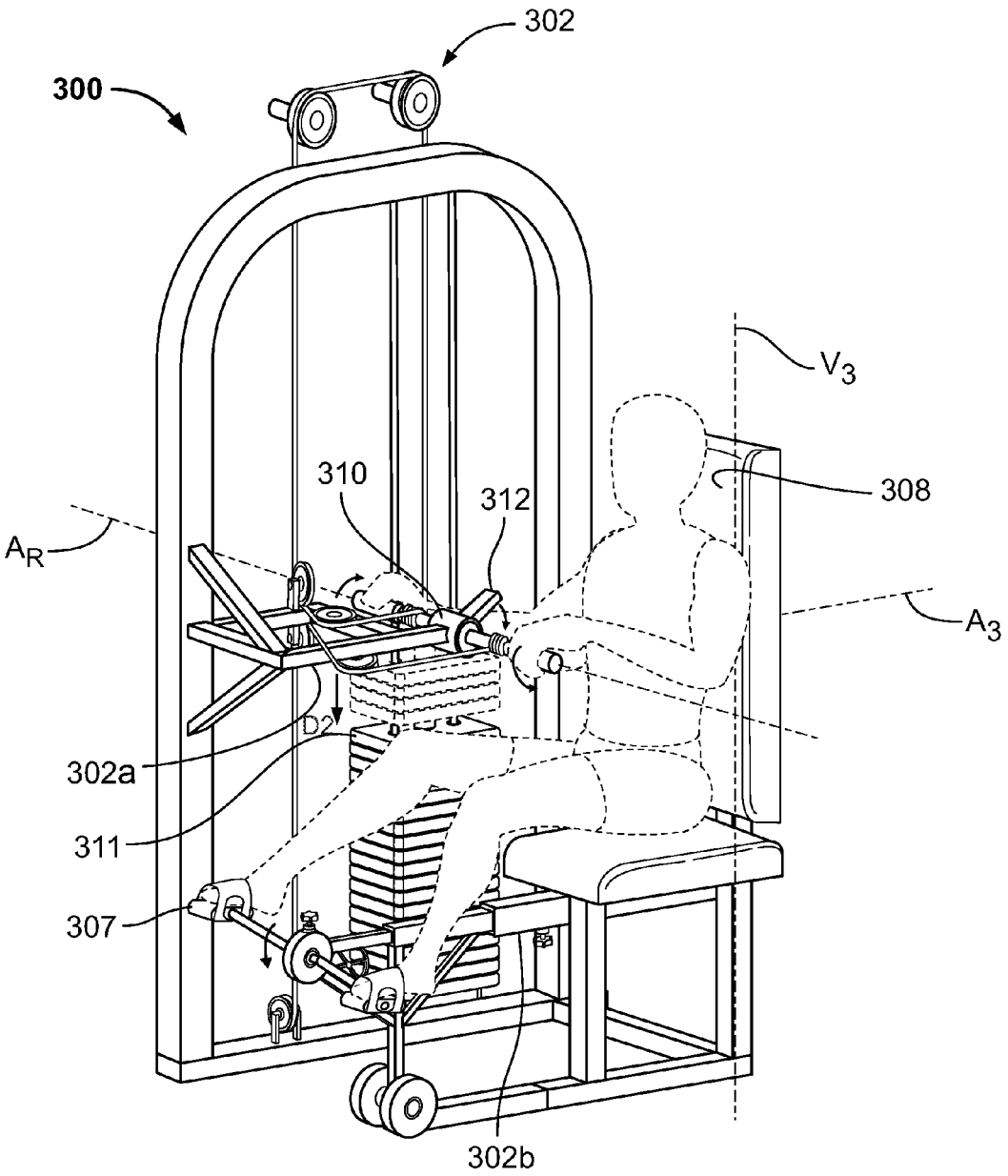
FIG. 3D is a second sequential perspective view of the physical exercise apparatus of FIG. 3A, being operated by a user.

As shown in FIG. 3C, load selector 312 is disposed such that rotation of the movable arms 310 by the user causes the selected portion 311*a* of resistance load 311 to move in a first direction $D_1$. Turning to FIG. 3D, a user may engage load selector 312 so that physical exercise apparatus 300 is reconfigured in a manner so that rotation of the movable arms 310 by the user causes the selected portion 311*a* of resistance load 311 to move in a second, opposite direction $D_2$.

In embodiments, the distraction of the lower body caused by the cycling motion of a user's lower body may substantially biomechanically isolate muscles of the lower body so that increased loading is experienced by target muscle groups. In such embodiments, target muscle groups may include the forearm extensors and/or flexors. In this manner, a user may be inhibited from twisting, jerking, and/or shifting when using the physical exercise apparatus 300 using muscles of the lower body of the user to leverage muscles of the upper body in performing forearm exercises with the movable arms 310.

Figure 4A:
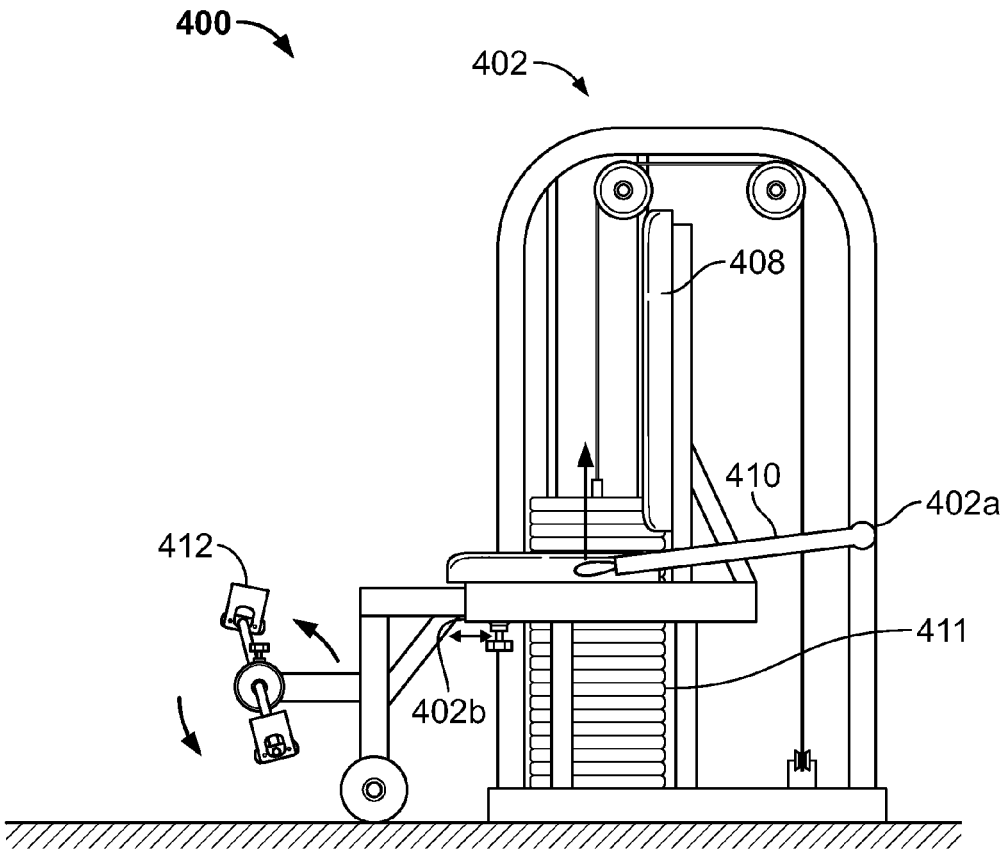
FIG. 4A is a side view of a physical exercise apparatus according to an exemplary embodiment of the present disclosure.

FIG. 4A shows a physical exercise apparatus, generally designated by reference number 400, according to an exemplary embodiment of the present disclosure. Physical exercise apparatus 400 may include a frame 402 having a first portion 402*a* and a second portion 402*b*. A seat 408 may be supported by the frame 402 and configured to support a user in an at least partially supine position. A pair of independently movable arms 410 may be movably coupled to the first portion 402*a* of the frame and configured for upward movement relative to the seat 408 so that a user can perform, for example, shoulder shrugs. In this manner, the pair of movable arms 410 may be configured to be pulled, shrugged, and/or lifted upwardly with respect to the seat 408. The first portion 402*a* of the frame 402 may be substantially stationary with respect to seat 408 so that each of the movable arms 410 may be movably coupled to the frame 402 at a respective substantially stationary coupling point. The pair of movable arms 410 may be positioned laterally spaced away from and substantially vertically aligned with the seat 408. In embodiments, each of the movable arms 410 may incorporate a gripping member, such as a handle. The pair of movable arms 410 may be coupled with a common, linearly movable resistance load 411. In embodiments, resistance load 411 may be an adjustable weight stack.

A pair of cycling foot pedals 412 may be coupled to the second portion 402*b* of frame 402 and independently movable from the pair of movable arms 410 so that the user can cycle the pair of cycling foot pedals 412 while separately moving the pair of arms 410 to perform shoulder shrugs. The second portion 402*b* of the frame 402 may be substantially stationary with respect to the seat 408 so that the cycling foot pedals 412 may be rotatably attached to the frame 402 and movable about a substantially stationary rotation axis. The pair of cycling foot pedals 412 may be positioned in front of the seat 408 and configured for engagement by a portion of a user's lower body.

Figure 4B:
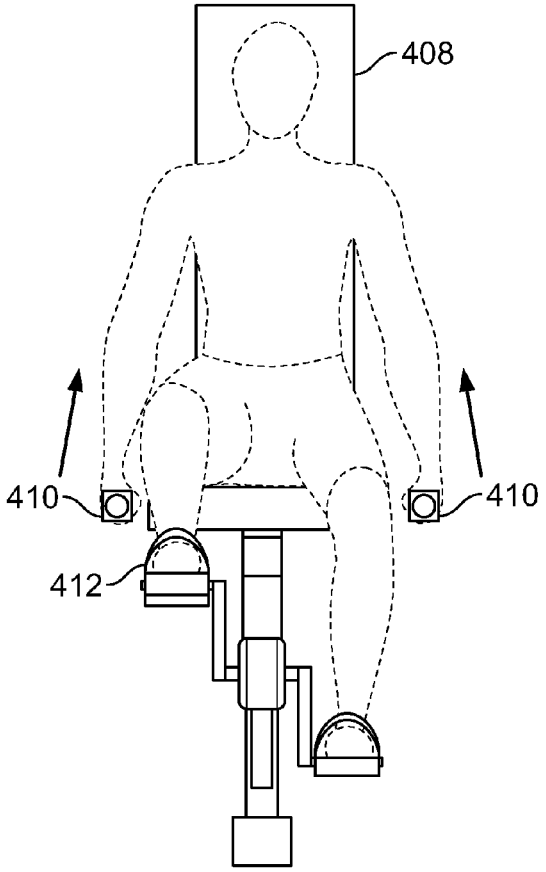
FIG. 4B is a front view of a portion of the physical exercise apparatus of FIG. 4A, with a user disposed thereon.
Figure 4C:
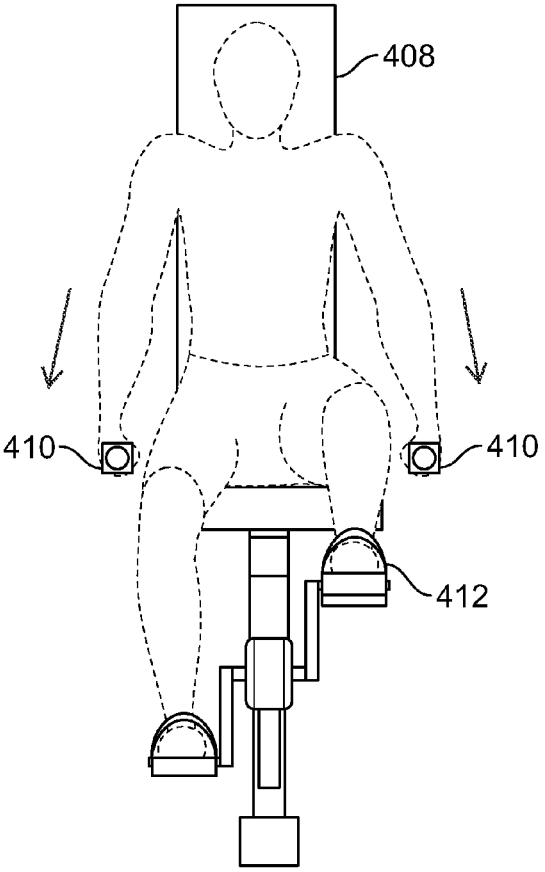
FIG. 4C is a front view of a portion of the physical exercise apparatus of FIG. 4A, being operated by a user.

Referring to FIG. 4B, a method of physical exercise training may comprise providing the physical exercise apparatus 400 and positioning at least a portion of a user's body in an at least partially supine position on the seat 408 of the frame 402. The user may access the pair of movable arms 410 with the user in the at least partially supine position. The user may also place his or her feet on the pair of cycling foot pedals 412 with the user in the at least partially supine position. Referring to FIG. 4C, the user may then simultaneously move the pair of movable arms 410 by raising the user's shoulders upwardly with the user's arms in a substantially extended position while independently cycling the pair of cycling foot pedals 412 with the user in the at least partially supine position. In embodiments, the user may continuously cycle the pair of cycling foot pedals 412 during movement of the pair of movable arms 410.

The cycling motion of the user's lower body may provide distraction so that the user is positioned in a manner to perform shoulder shrugs with the pair of movable arms 410 so that a substantially even resistive loading is received by, for example, the user's trapezus and/or levator scapulae muscles. In this manner, a resistive loading may be transferred to the user's trapezus and/or levator scapulae muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

In embodiments, the distraction of the lower body caused by the cycling motion of a user's lower body may substantially biomechanically isolate muscles of the lower body so that increased loading is experienced by target muscle groups. In such embodiments, target muscle groups may include the trapezus and/or levator scapulae muscles. In this manner, a user may be inhibited from twisting, jerking, and/or shifting when using the physical exercise apparatus 400 using muscles of the lower body of the user to leverage muscles of the upper body in performing shoulder shrugs with the pair of movable arms 410.

Figure 5A:
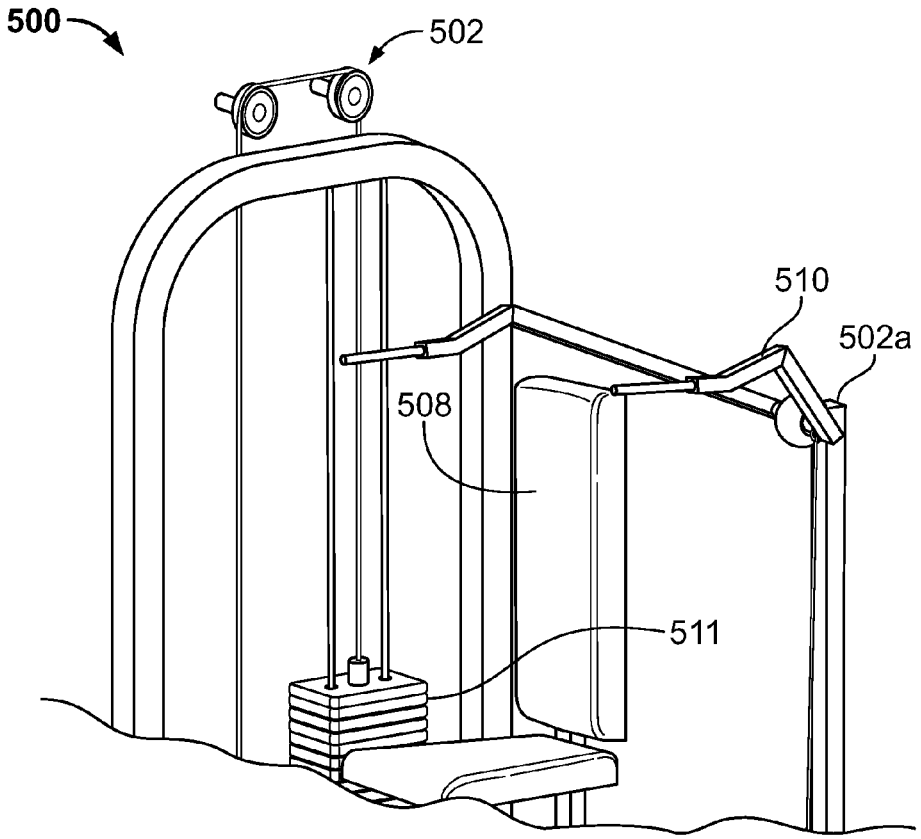
FIG. 5A is a perspective view of a physical exercise apparatus according to an exemplary embodiment of the present disclosure.

FIG. 5A shows a physical exercise equipment apparatus, generally designated by reference number 500, according to an exemplary embodiment of the present disclosure. Physical exercise equipment apparatus 500 may include a frame 502 that includes a first portion 502*a*. A seat 508 may be supported on the frame 502 and configured to support a user in an at least partially supine position. A pair of independently movable arms 510 may be movably coupled to the first portion 502*a* of the frame 502 and configured to move upwardly relative to the seat 508. The pair of movable arms 510 may be configured to be pressed, pushed, lifted, and/or raised upwardly and/or overhead with respect to seat 508 so that a user can perform, for example, shoulder presses with the pair of movable arms 510. The first portion 502*a* of frame 502 may be substantially stationary with respect to seat 508 so that each movable arm 510 may be movably coupled to the frame 502 at a respective substantially stationary coupling point. In embodiments, each movable arm 510 may incorporate a gripping member, such as a handle, positioned level with or above a user's head in an at least partially supine position on the seat 508. The pair of movable arms 510 may be coupled with a common, linearly movable resistance load 511. In embodiments, resistance load 511 may be an adjustable weight stack.

Figure 5B:
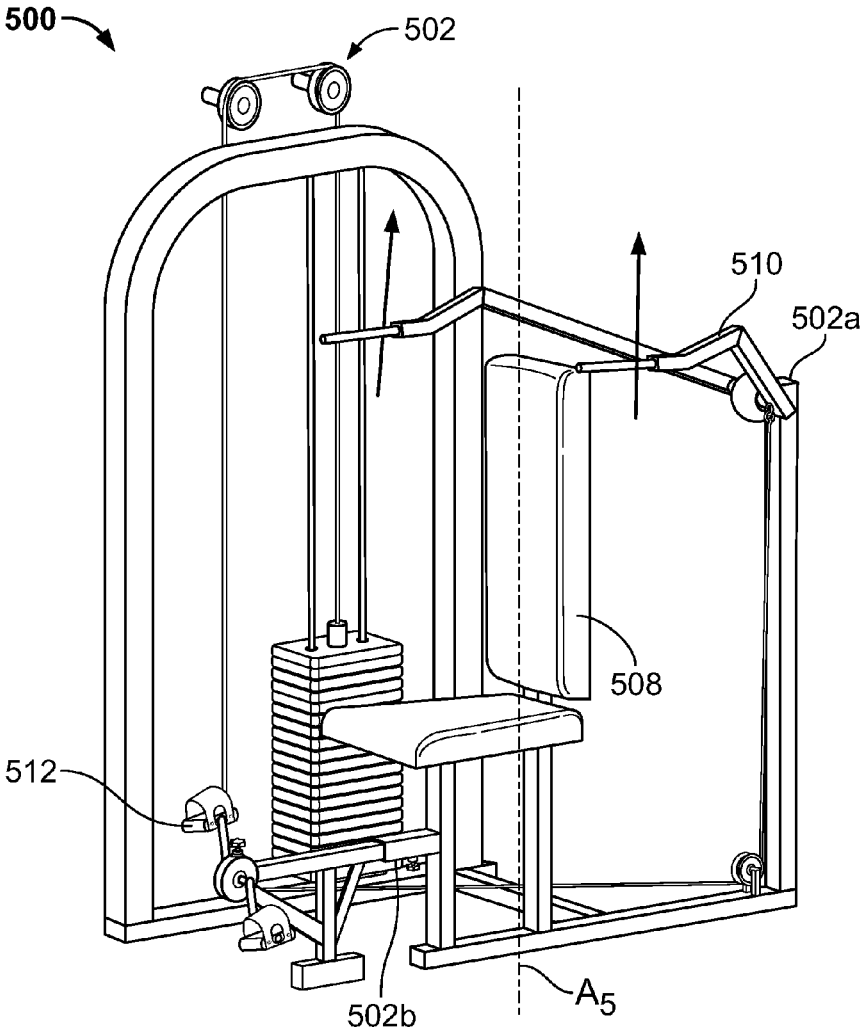
FIG. 5B is a perspective view of a physical exercise apparatus according to an exemplary embodiment of the present disclosure.

Turning to FIG. 5B, in an exemplary embodiment, a pair of cycling foot pedals 512 may be coupled with the second portion 502*b* of the frame 502 of physical exercise apparatus 500. Cycling foot pedals 512 may be independently movable from the pair of movable arms 510 so that the user can cycle the pair of cycling foot pedals 512 while separately moving the pair of movable arms 510 to perform shoulder presses. The second portion 502*b* of frame 502 may be substantially stationary with respect to seat 508 so that the cycling foot pedals 512 may be rotatably coupled to the frame 502 and movable about a substantially stationary rotation axis. The pair of cycling foot pedals 512 may be positioned in front of the seat 508 and configured for engagement by a portion of a user's lower body.

Figure 5C:
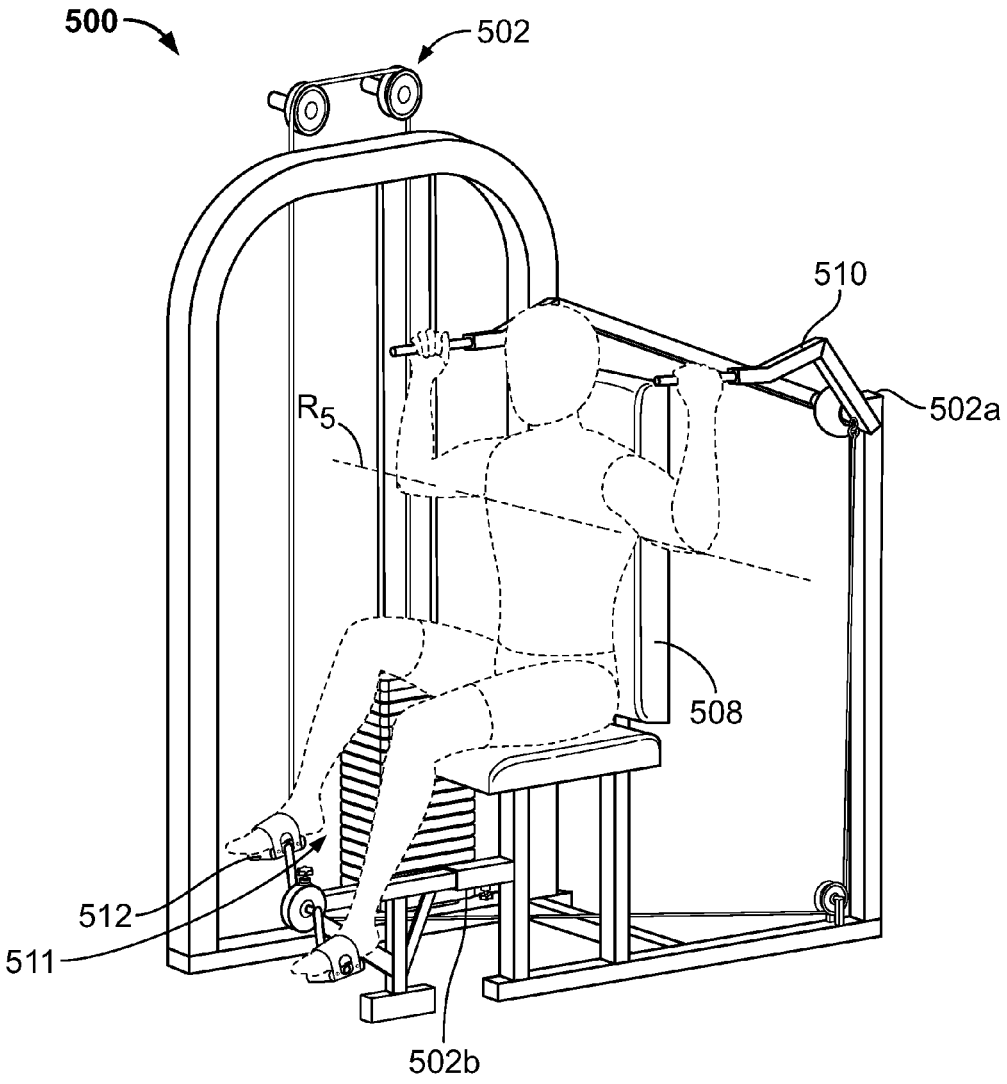
FIG. 5C is a perspective view of the physical exercise apparatus of FIG. 5B, with a user disposed thereon.

Referring to FIG. 5C, a method of physical exercise training may comprise providing the physical exercise apparatus 500 and positioning at least a portion of a user's body in an at least partially supine position on the seat 508. A user may access the pair of movable arms 510 with the user in the at least partially supine position. In embodiments, the user may grasp the pair of movable arms 510 with the palms of his or her hands disposed facing each other. The user may also place his or her feet on the pair of cycling foot pedals 512 in the at least partially supine position. The user's arms may be initially positioned so that an angle of between and including about 70 degrees and about 80 degrees, such as 75 degrees, is formed between the user's humerus and a reference line $R_5$ formed by the user's lateral thorax. In embodiments, the user's arms may be initially positioned so that a different angle is formed between the user's humerus and the reference line $R_5$.

Figure 5D:
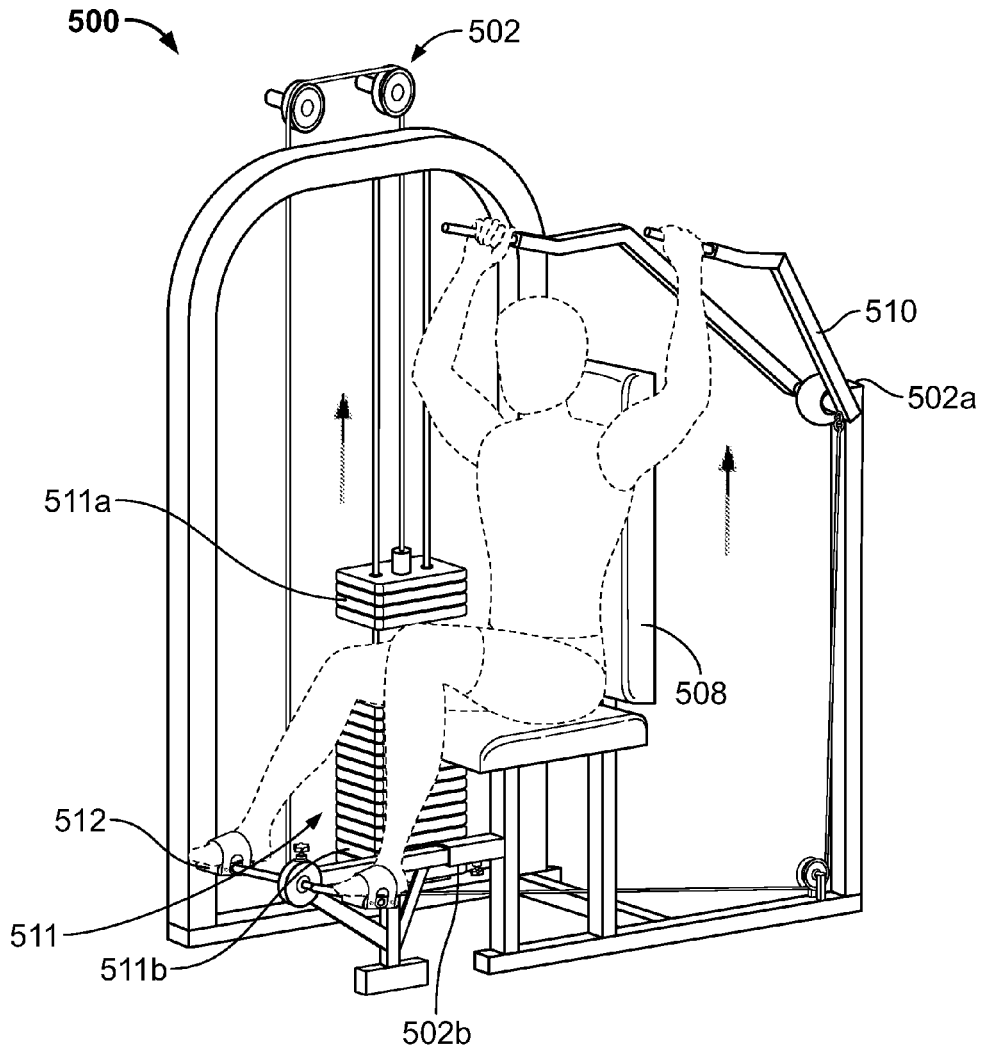
FIG. 5D is a first sequential perspective view of the physical exercise apparatus of FIG. 5B, being operated by a user.

Referring to FIG. 5D, the user may simultaneously move the pair of movable arms 510 while independently cycling the pair of cycling foot pedals 512 with the user in the at least partially supine position. In embodiments, the user may continuously cycle the pair of cycling foot pedals 512 during movement of the pair of movable arms 510. The user may press, push, raise, and/or lift the pair of movable arms 510 upwardly and/or overhead with respect to the seat 508. The pair of movable arms 510 may be configured to approach an apex above the user's head so that the pair of movable arms 510 may approximate toward each other as they are pressed upwardly to come into contact at or substantially near contact along an axial midline of the user's body. Movable arms 510 may move along respective oblique, linear paths so that movable arms 510 converge and diverge about an axial midline extending vertically through the user's body during use of physical exercise apparatus 500.

Figure 5E:
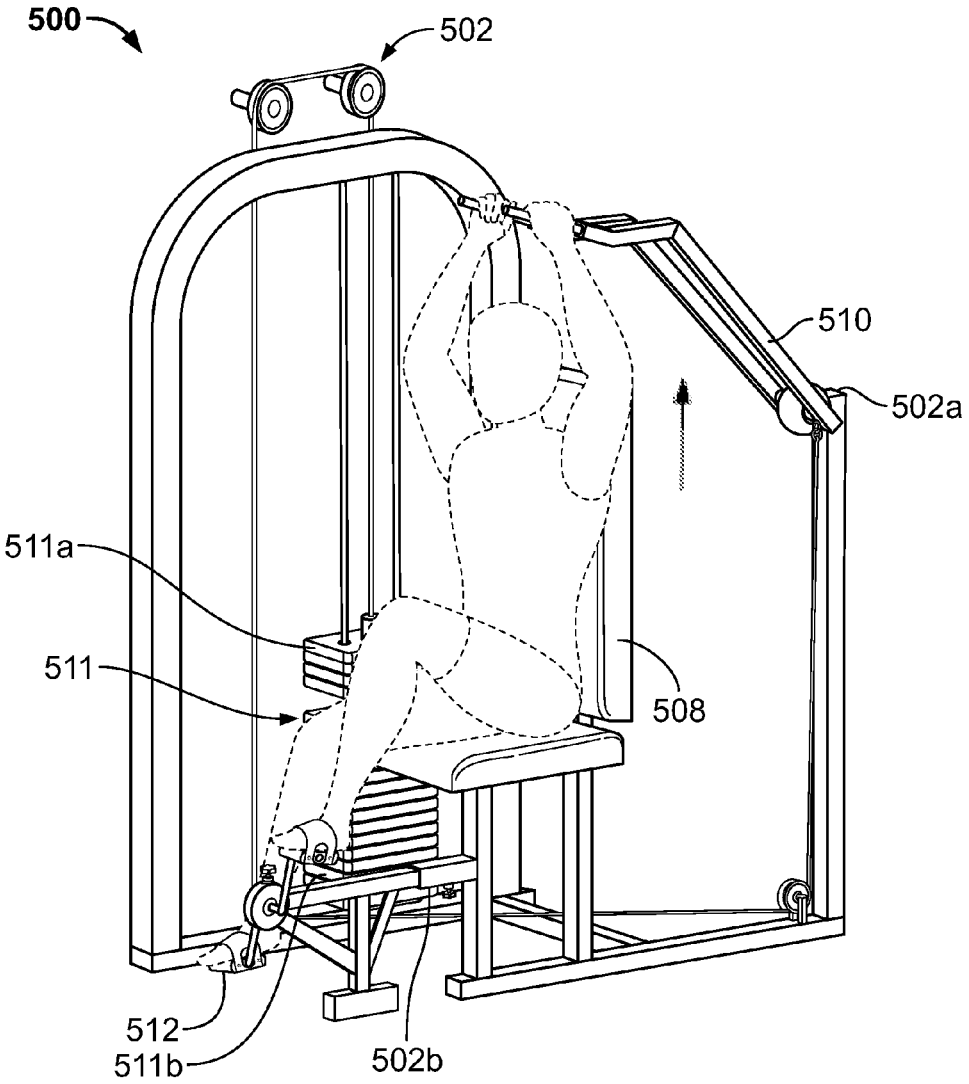
FIG. 5E is a second sequential perspective view of the physical exercise apparatus of FIG. 5B, being operated by a user.

Turning to FIG. 5E, the user's arms may have an extended position so that an angle of between and including about 168 degrees and about 178 degrees, such as 173 degrees, is formed between the reference line $R_5$ and the user's humerus. In embodiments, the user's arms may be disposed at a different angle formed between the reference line $R_5$ and the user's humerus in an extended position. Pressing of the movable arms 510 by the user may cause a selected portion 511*a* of the resistance load 511 to linearly move along the frame 502. An unselected portion 511*b* of the resistance load 511 may remain stationary along the frame 502. In embodiments, a selected portion 511*a* of the resistance load 511 may comprise the entire resistance load 511.

The cycling motion of the user's lower body may provide distraction so that the user is positioned in a manner to perform shoulder presses with the pair of movable arms 510 so that a substantially even resistive loading is received by, for example, the user's deltoid muscles. In this manner, a resistive loading may be transferred to the user's deltoid muscles that is symmetric about an axial midline of the user's body. The movable arms 510 may be positioned sufficiently rearward of the reference line $R_5$ so that muscles other than the user's deltoid muscles, for example, the user's pectoralis muscles, trapezius muscles, and/or levator scapulae muscles are inhibited from assisting in performing shoulder presses.

Such a resistive loading may minimize, prevent, and/or improve muscular imbalances, and may encourage and/or maintain symmetrical development of muscles with respect to an axial midline of the body within target muscle groups.

In embodiments, the distraction of the lower body caused by the cycling motion of a user's lower body may substantially biomechanically isolate muscles of the lower body so that increased loading is experienced by target muscle groups. In such embodiments, target muscle groups may include the deltoid muscles. In this manner, a user may be inhibited from twisting, jerking, and/or shifting when using the physical exercise apparatus 500 using muscles of the lower body of the user to leverage muscles of the upper body in performing shoulder presses with the pair of movable arms 510.

Figure 6A:
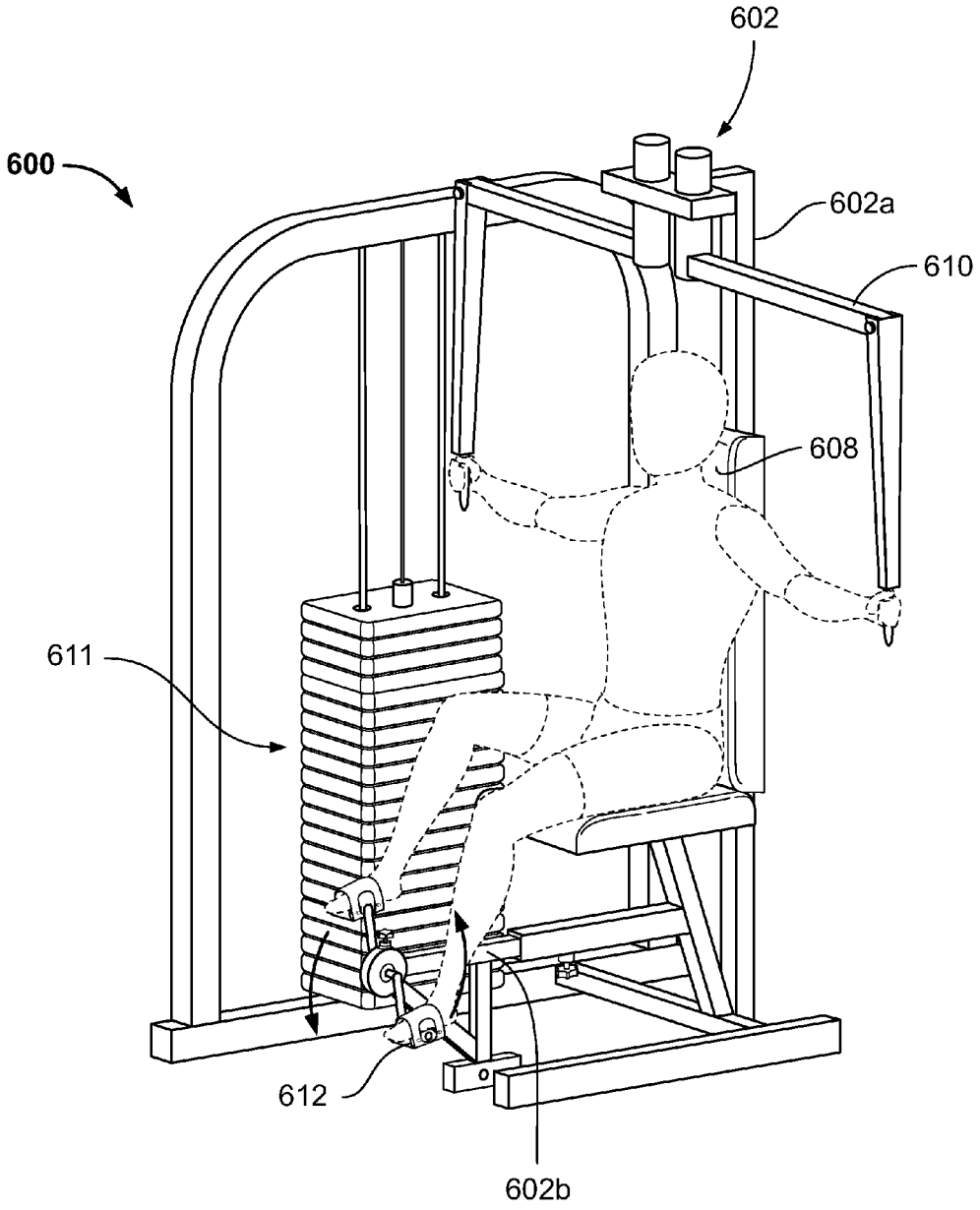
FIG. 6A is a perspective view of a physical exercise apparatus according to an exemplary embodiment of the present disclosure, with a user disposed thereon.

FIG. 6A shows a physical exercise apparatus, generally designated by reference number 600, according to an exemplary embodiment of the present disclosure. Physical exercise apparatus 600 may include a frame 602 that has a first portion 602*a* and a second portion 602*b*. A seat 608 may be supported by the frame 602 and configured to a support a user in an at least partially supine position. A pair of independently movable arms 610 may be movably coupled to the first portion 602*a* of the frame 602. The pair of movable arms 610 may be configured to be pulled forward from and laterally inwardly with respect to the seat 608 so that a user can perform pectoral fly exercises with the pair of movable arms 610. The first portion 602*a* of frame 602 may be substantially stationary with respect to seat 608 so that each of the movable arms 610 may be movably coupled to a respective substantially stationary coupling point on the frame 602. The pair of movable arms 610 may be positioned laterally spaced away from the seat 608. In embodiments, each movable arm 610 may incorporate a gripping member, such as a handle. The pair of movable arms 610 may be coupled with a common, linearly movable resistance load 611. In embodiments, resistance load 611 may be an adjustable weight stack.

A pair of cycling foot pedals 612 may be coupled to the second portion 602*b* of the frame 602 and independently movable from the pair of movable arms 610 so that the user can cycle the pair of cycling foot pedals 612 while separately moving the pair of movable arms 610 to perform pectoral fly exercises. The second portion 602*b* of the frame 602 may be substantially stationary with respect to seat 608 so that the cycling foot pedals 612 may be rotatably coupled to the frame 602 and movable about a substantially stationary rotation axis. The pair of cycling foot pedals 612 may be positioned in front of the seat 608 and configured for engagement by a portion of a user's lower body.

Figure 6B:
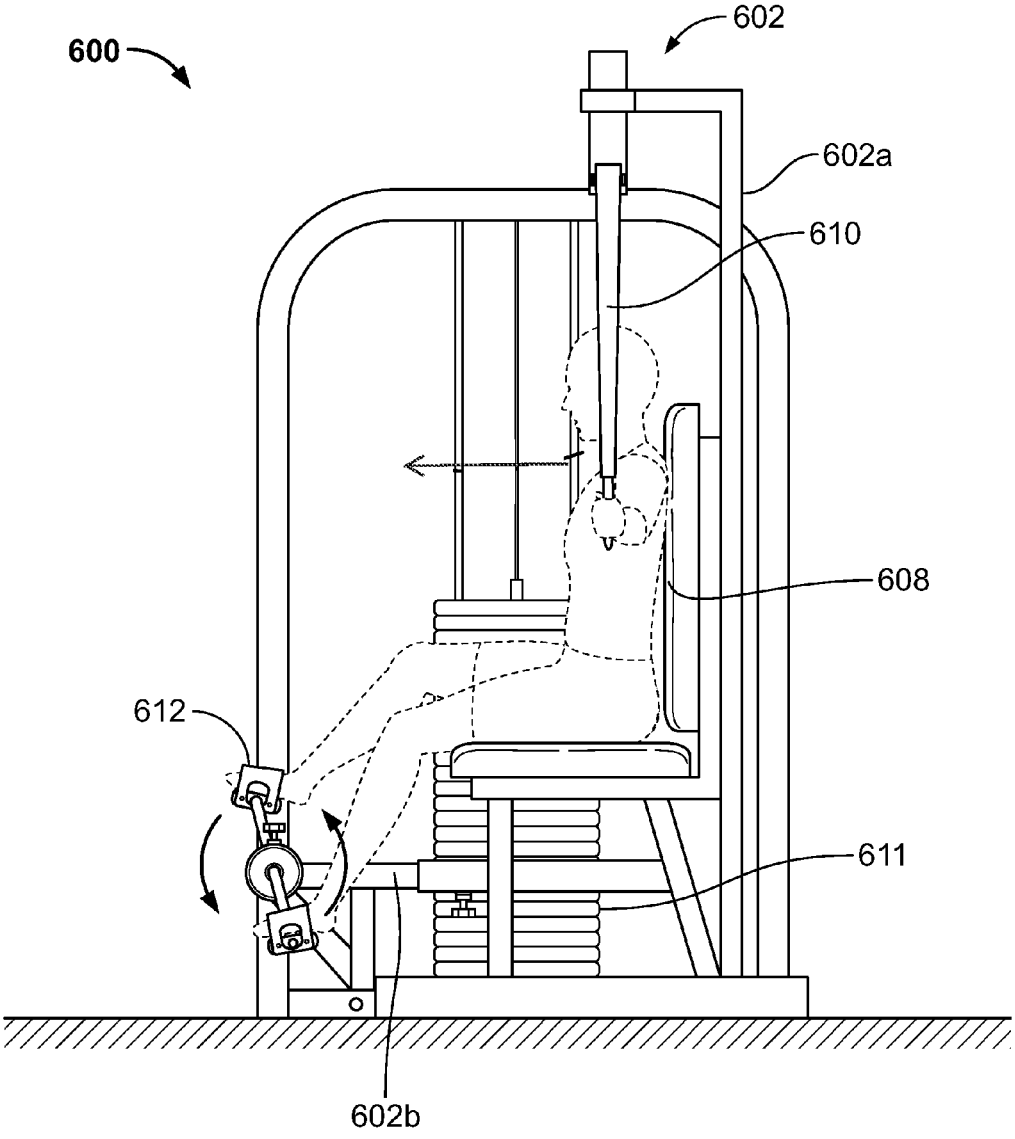
FIG. 6B is a side view of the physical exercise apparatus of FIG. 6A, with a user disposed thereon.

Referring to FIG. 6B, a method of physical exercise training may comprise providing the physical exercise apparatus 600 and positioning at least a portion of a body of a user in an at least partially supine position on the seat 608. The user may access the pair of movable arms 610 with the user in the at least partially supine position. The user may also place his or her feet on the cycling foot pedals 612 with the user in the at least partially supine position.

Figure 6C:
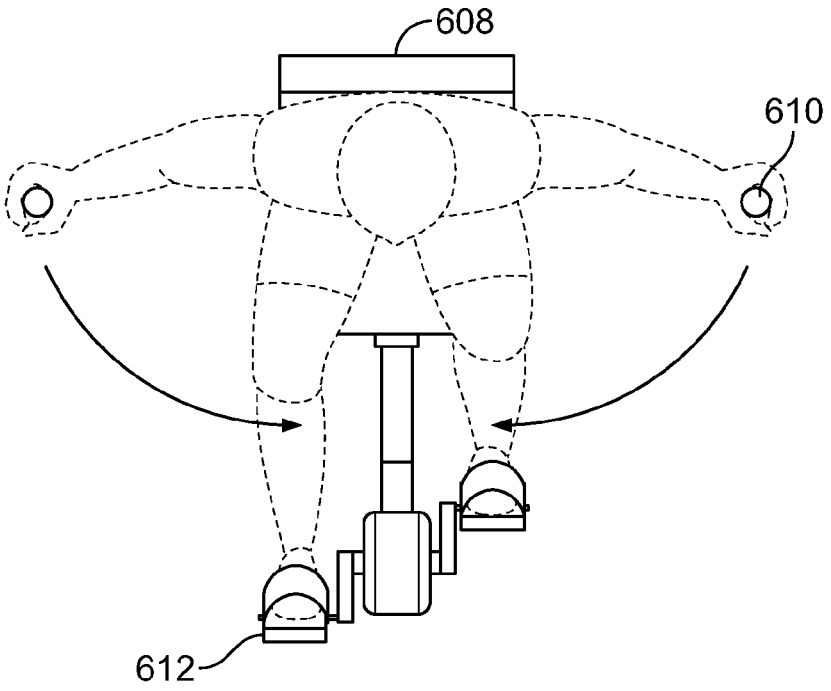
FIG. 6C is a first sequential top plan view of a portion of the physical exercise apparatus of FIG. 6A, with a user disposed thereon.
Figure 6D:
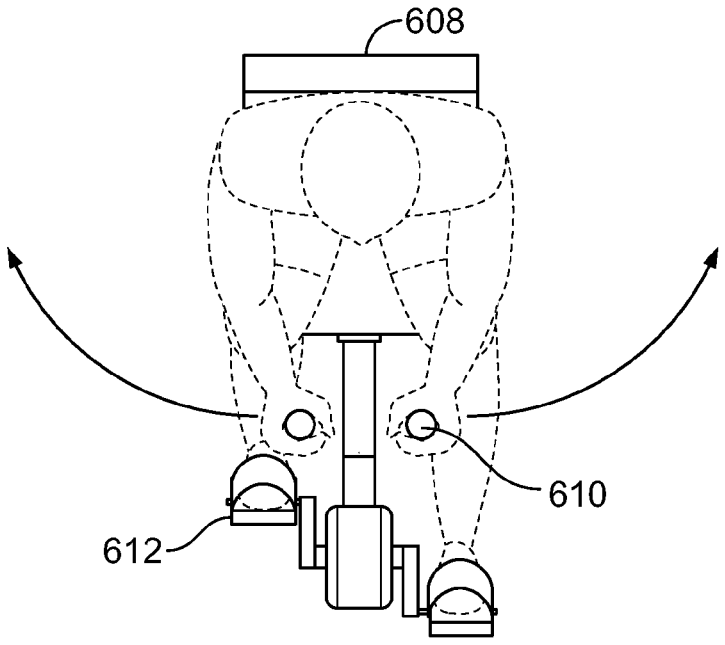
FIG. 6D is a second sequential top plan view of a portion of the physical exercise apparatus of FIG. 6A, being operated by a user.

With reference to FIGS. 6C and 6D, the user may then simultaneously move the movable arms 610 while independently cycling the cycling foot pedals 612 with the user in the at least partially supine position. In embodiments, the user may continuously cycle the pair of cycling foot pedals 612 during movement of the pair of movable arms 610. In embodiments, the user may move the pair movable arms 610 so that the movable arms 610 are moved forward from the seat 608 with the user's arms substantially outstretched to the user's lateral sides. Referring to FIG. 6E, the user may pull the pair of movable arms 610 laterally inwardly with respect to the seat 608 so that the pair of movable arms 610 adduct or approximate together to a position substantially centered and in front of the user in the at least partially supine position on the seat 608.

The cycling motion of the user's lower body may provide distraction so that the user is positioned in a manner to perform pectoral fly movements with the pair of movable arms 610 so that a substantially even resistive loading is received by, for example, the user's pectoralis muscles. In this manner, a resistive loading may be transferred to the user's pectoralis muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

In embodiments, the distraction of the lower body caused by the cycling motion of a user's lower body may substantially biomechanically isolate muscles of the lower body so that increased loading is experienced by target muscle groups. In such embodiments, target muscle groups may include the pectoralis muscles. In this manner, a user may be inhibited from twisting, jerking, and/or shifting when using the physical exercise apparatus 600 using muscles of the lower body of the user to leverage muscles of the upper body in performing pectoral fly movements with the pair of movable arms 610.

Figure 7A:
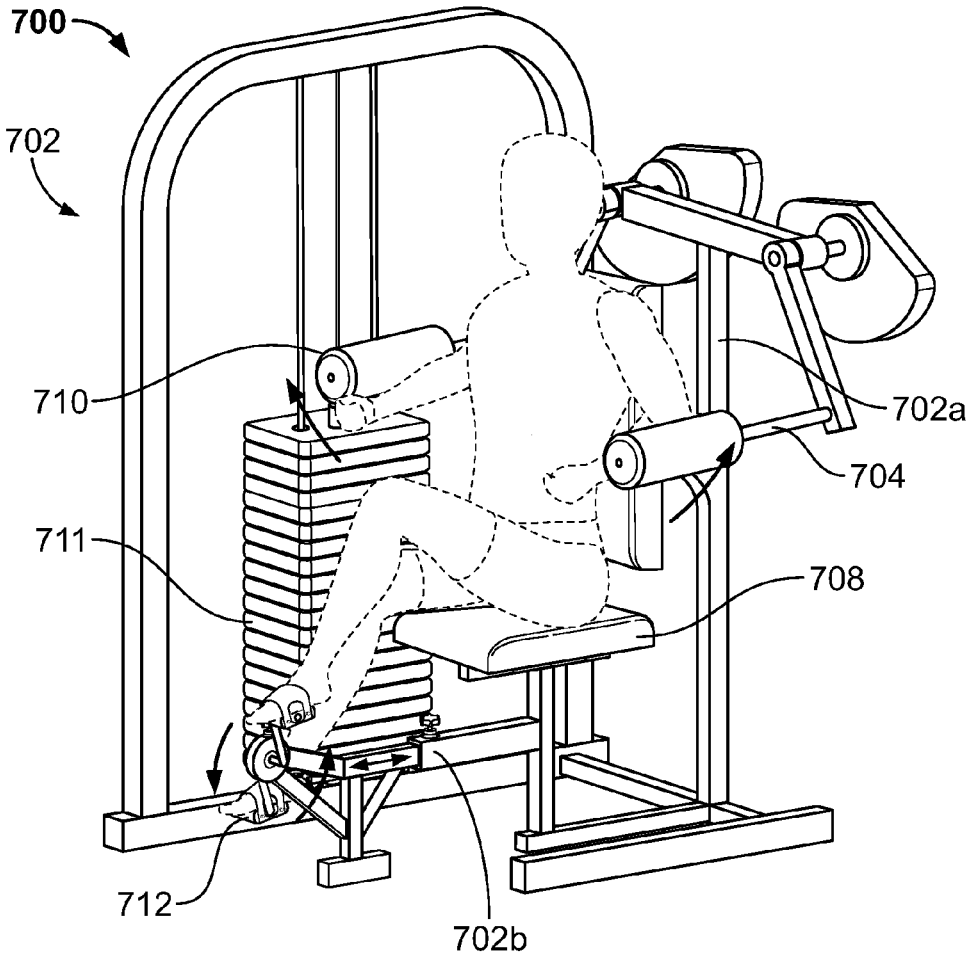
FIG. 7A is a perspective view of a physical exercise apparatus according to an exemplary embodiment of the present disclosure, with a user disposed thereon.

FIG. 7A shows a physical exercise apparatus, generally designated by reference number 700, according to an exemplary embodiment of the present disclosure. Exercise equipment apparatus 700 may include a frame 702 having a first portion 702*a* and a second portion 702*b*. A seat 708 may be supported by frame 702 and configured to support a user in an at least partially supine position. A pair of independently movable arms 710 may be movably coupled to the first portion 702*a* of the frame 702. The pair of movable arms 710 may be configured to be pushed or raised laterally outwardly and/or upwardly with respect to the seat 708 so that a user can perform, for example, lateral raises with the pair of movable arms 710. In embodiments, first portion 702*a* of frame 702 may be substantially stationary with respect to seat 708 so that each of the movably mounted arms 710 may be movably coupled to a respective substantially stationary coupling point on the frame 702. The pair of movable arms 710 may be coupled with a common, linearly movable resistance load 711. In embodiments, the resistance load 711 may be an adjustable weight stack.

A pair of cycling foot pedals 712 may be coupled to the second portion 702*b* of the frame 102 and independently movable from the pair of movable arms 710 so that a user can cycle the pair of cycling foot pedals 712 while separately moving the pair of movable arms 710 to perform lateral raises. In embodiments, the second portion 702*b* of the frame 702 may be substantially stationary with respect to the seat 708 so that the cycling foot pedals 712 may be rotatably coupled to the frame 702 and movable about a substantially stationary rotation axis. The pair of cycling foot pedals 712 may be positioned in front of the seat 708 and configured for engagement by a portion of a user's lower body.

Figure 7B:
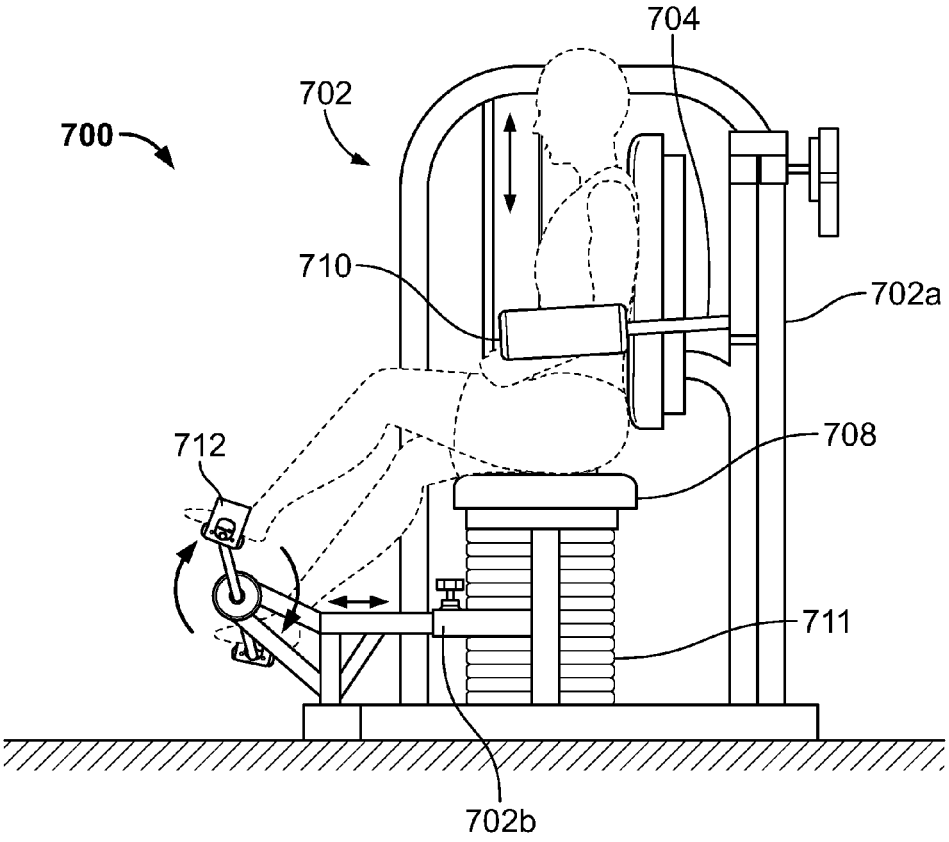
FIG. 7B is a side view of the physical exercise apparatus of FIG. 7A.
Figure 7C:
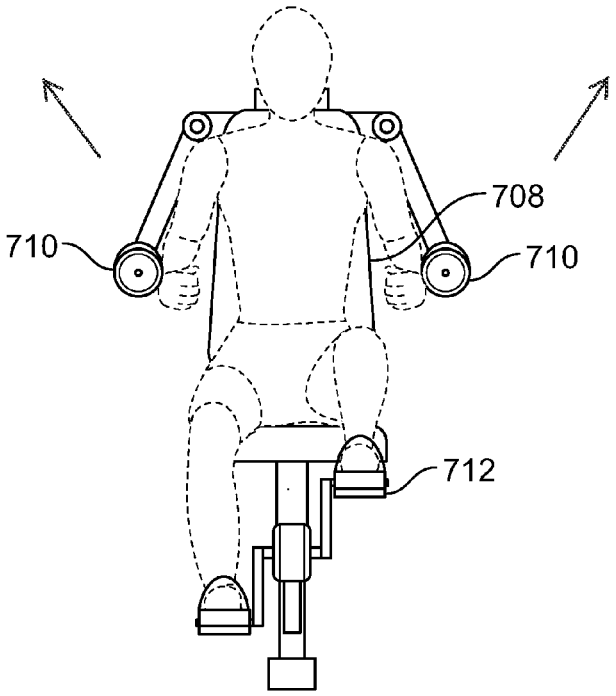
FIG. 7C is a front view of a portion of the physical exercise apparatus of FIG. 7A.
Figure 7D:
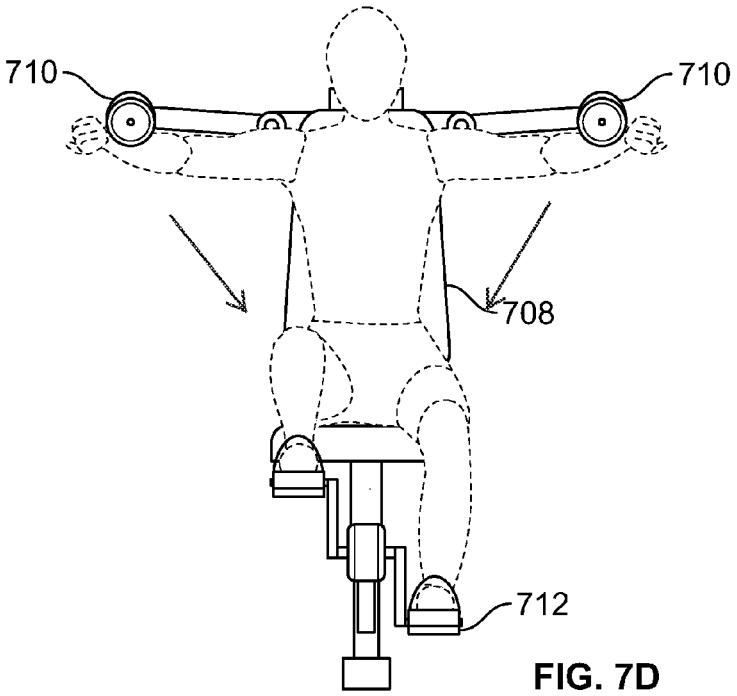
FIG. 7D is a front view of a portion of the physical exercise apparatus of FIG. 7A, being operated by a user.

With reference to FIG. 7B, a method of performing physical exercise may comprise providing physical exercise apparatus 700 and positioning at least a portion of a body of a user in an at least partially supine position on the seat 708. The user may access the pair of movable arms 710 with the user in the at least partially supine position. Referring to FIGS. 7C and 7D, the user may engage the inside surface of each of the pair of movable arms 710 with outer portions of the user's arms, such as the user's elbow, forearm and/or upper arm, so that the user may press his or her arms outwardly and/or upwardly against the inside surface of each of the pair of movable arms 710 to move the pair of movable arms 710 to a position substantially level with the user's shoulders and laterally outwardly with respect to seat 708. In embodiments, movable arms 710 may be raised to a level about ⅔ the vertical level of the user's shoulders. In embodiments, the user may move the movable arms 710 with the user's arms in about a 90 degree bent position. In embodiments, the user may move the movable arms 710 with the user's arms in a different position, such as between about an 85 degree and about a 95 degree bent position.

The user may simultaneously move the pair of movable arms 710 and independently cycle the pair of cycling foot pedals 712 with the user in the at least partially supine position. In embodiments, the user may continuously cycle the pair of cycling foot pedals 712 during movement of the pair of movable arms 710. In embodiments, the user may engage the pair of movable arms 710 to push and/or raise the pair of movable arms 710 laterally outwardly and/or upwardly with respect to the seat 708.

The cycling motion of the user's lower body may provide distraction so that the user is positioned in a manner to perform lateral raises with the pair of movable arms 710 so that a substantially even resistive loading is received by, for example, the user's deltoid muscles. In this manner, a resistive loading may be transferred to the user's deltoid muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

Figure 8A:
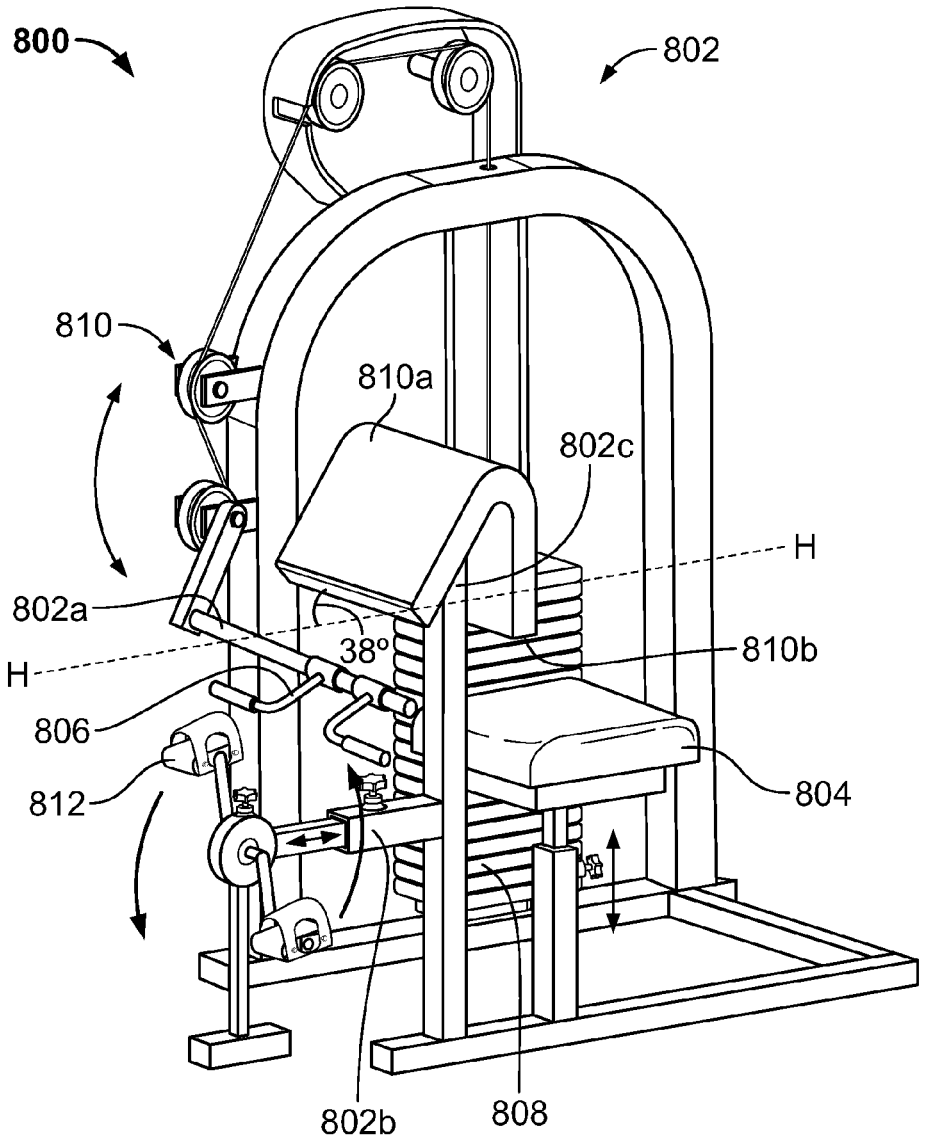
FIG. 8A is a perspective view of a physical exercise apparatus according to an exemplary embodiment of the present disclosure.

FIG. 8A shows an exercise equipment apparatus, generally designated by reference number 800, according to an exemplary embodiment of the present disclosure. Exercise equipment apparatus 800 may include a frame 802 having a first portion 802*a*, a second portion 802*b*, and a third portion 802*c*. A seat 804 may be supported by the frame and configured to support a user in an at least partially supine position.

A pair of independently movable arms 806 may be movably coupled to the first portion 802*a* of the frame 802. Movable arms 806 may be configured to be pulled toward seat 804 so that a user can perform bicep curls with the movable arms 806. In embodiments, the first portion 802*a* of the frame 802 may be substantially stationary with respect to seat 804 so that the movable arms 806 may be movably coupled to a substantially stationary coupling point on the frame 802. In embodiments, movable arms 806 may comprise a single movable arm or bar configured to be used by both of a user's arms and symmetrically arranged about an axial midline of seat 804.

Movable arms 806 may be coupled with a linearly movable resistance load 808. In embodiments, resistance load 808 may be an adjustable weight stack. In embodiments, each movable arm 806 may be coupled with a separate weight stack. In embodiments, movable arms 806 may be coupled with resistance load 808 with one or more pulleys and/or cables.

A mounted pad 810 may be supported by the third portion 802*c* of the frame 802. Mounted pad 810 may be configured to support a portion of a user's upper body, such as a user's arms and/or chest. In embodiments, mounted pad 810 may include a front surface 810*a* that is disposed at an incline of about 38 degrees with respect to a horizontal line H drawn along a bottom surface 810*b* of the mounted pad 810. In embodiments, front surface 810*a* may be disposed at another angle with respect to the horizontal line H.

A pair of cycling foot pedals 812 may be coupled to the second portion 802*b* of the frame 802. The pair of cycling foot pedals 812 may be independently movable from the movable arms 806 so that the user can cycle the pair of cycling foot pedals 812 while separately moving the movable arms 806 to perform bicep curls. In embodiments, the second portion 802*b* may be substantially stationary with respect to the seat 808 so that the pair of cycling foot pedals 812 may rotatably coupled to the frame 802 about a substantially stationary rotation axis.

Figure 8B:
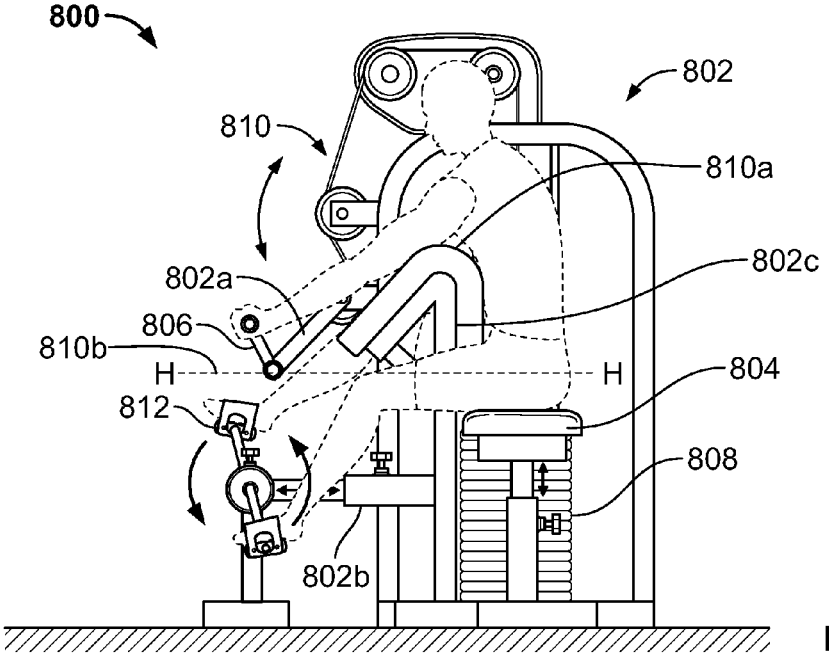
FIG. 8B is a side view of the physical exercise apparatus of FIG. 8A, with a user disposed thereon.

Referring to FIG. 8B, a method of physical exercise training may comprise providing physical exercise apparatus 800 and positioning at least a portion of a user's body on the seat 804 in an at least partially supine position. The user may access the movable arms 806 with the user in the at least partially supine position on the seat 804. The user may also place his or her feet on the pair of cycling foot pedals 812 in the at least partially supine position on the seat 804.

Figure 8C:
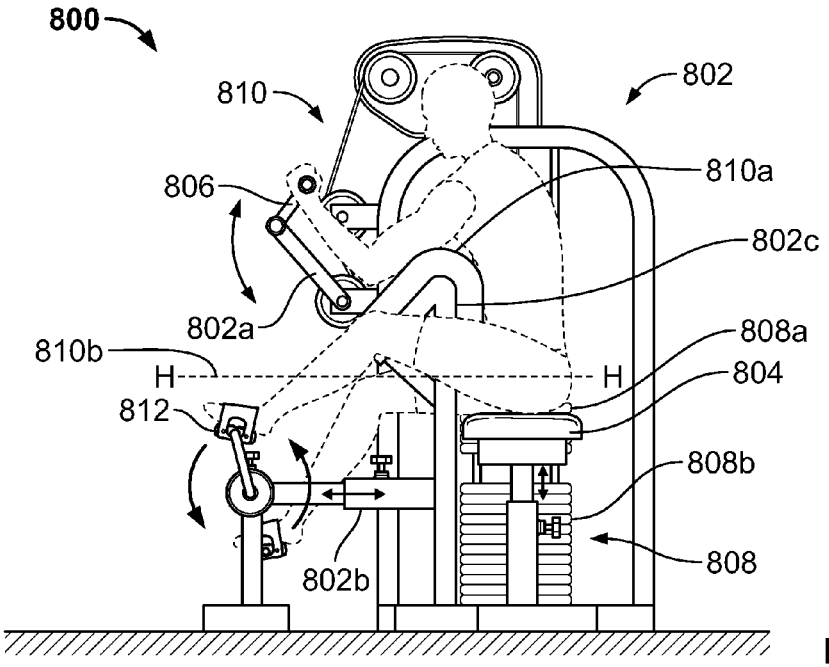
FIG. 8C is a side view of the physical exercise apparatus of FIG. 8A, being operated by a user.

Referring to FIG. 8C, the user may simultaneously move the movable arms 806 and independently cycle the pair of cycling foot pedals 812 with the user in the at least partially supine position. In embodiments, the user may continuously cycle the pair of cycling foot pedals 812 during movement of the pair of movable arms 806. The user may pull the movable arms 806 over the mounted pad 810 toward a portion of the upper body of the user. In such embodiments, the user may pull or curl the movable arms 806 concentrically over the mounted pad 810 toward the seat 804. In such embodiments, the mounted pad 810 may provide a supporting surface to maintain a user's upper body in a position to perform curls with the movable arms 806. In embodiments, such curls with the movable arms 806 may provide resistance to a user's biceps brachii and/or other regions of the user's upper body. Curling of the movable arms 806 by the user may cause a selected portion 808*a* of the resistance load 808 to linearly move along the frame 802. An unselected portion 808*b* of the resistance load 808 may remain stationary along the frame 802. In embodiments, a selected portion 808*a* of the resistance load 808 may comprise the entire resistance load 808.

The cycling motion of the user's lower body may provide distraction so that the user is positioned in a manner to perform bicep curls with the pair of movable arms 806 so that a substantially even resistive loading is received by, for example, the user's bicep muscles. In this manner, a resistive loading may be transferred to the user's bicep muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

Figure 9A:
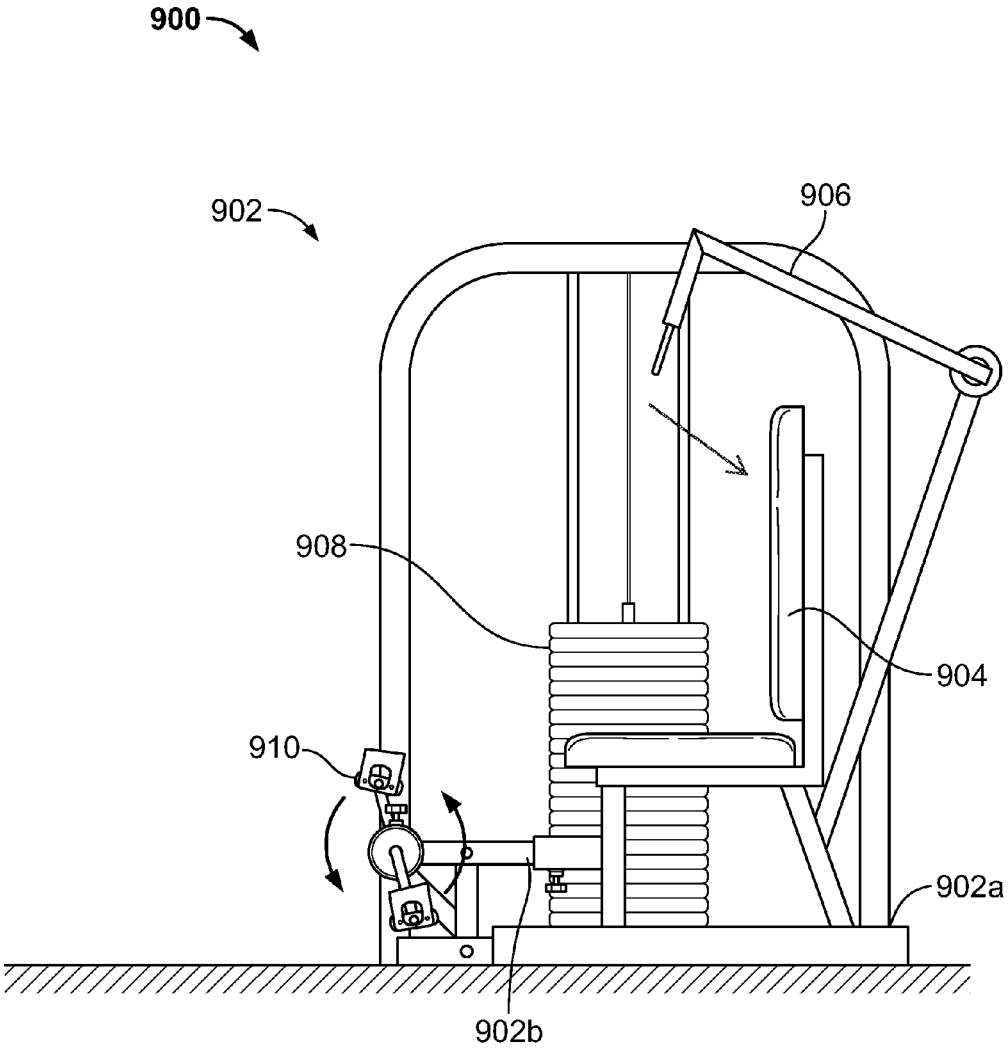
FIG. 9A is a side view of a physical exercise apparatus according to an exemplary embodiment of the present disclosure, with a user disposed thereon.

FIG. 9A shows a physical exercise apparatus, generally designated by reference number 900, according to an exemplary embodiment of the present disclosure. Physical exercise apparatus 900 may include a frame 902 having a first portion 902*a* and a second portion 902*b*. A seat 904 may be supported by the frame 902 and configured to support a user in an at least partially supine position.

A pair of independently movable arms 906 may be movably coupled to the first portion 902*a* of the frame 902. The pair of movable arms 906 may be configured to be pulled downwardly and/or laterally away from the seat 904 so that the user can perform, for example shoulder retractions with the pair of movable arms 906. The first portion 902*a* of the frame 902 may be substantially stationary with respect to the seat 904 so that the pair of movable arms 906 may be movably coupled to a substantially stationary coupling point on the frame 902. The pair of movable arms 906 may be coupled with a linearly movable resistance load 908. In embodiments, resistance load 908 may be an adjustable weight stack.

A pair of cycling foot pedals 910 may be coupled to the second portion 902*b* of frame 902 and independently movable from the pair of movable arms 906 so that the user can cycle the pair of cycling foot pedals 910 while separately moving the pair of arms 906 to perform shoulder retractions. The second portion 902*b* of the frame 902 may be substantially stationary with respect to the seat 904 so that the cycling foot pedals 910 may be rotatably attached to the frame 902 and movable about a substantially stationary rotation axis. The pair of cycling foot pedals 910 may be positioned in front of the seat 904 and configured for engagement by a portion of a user's lower body.

Figure 9B:
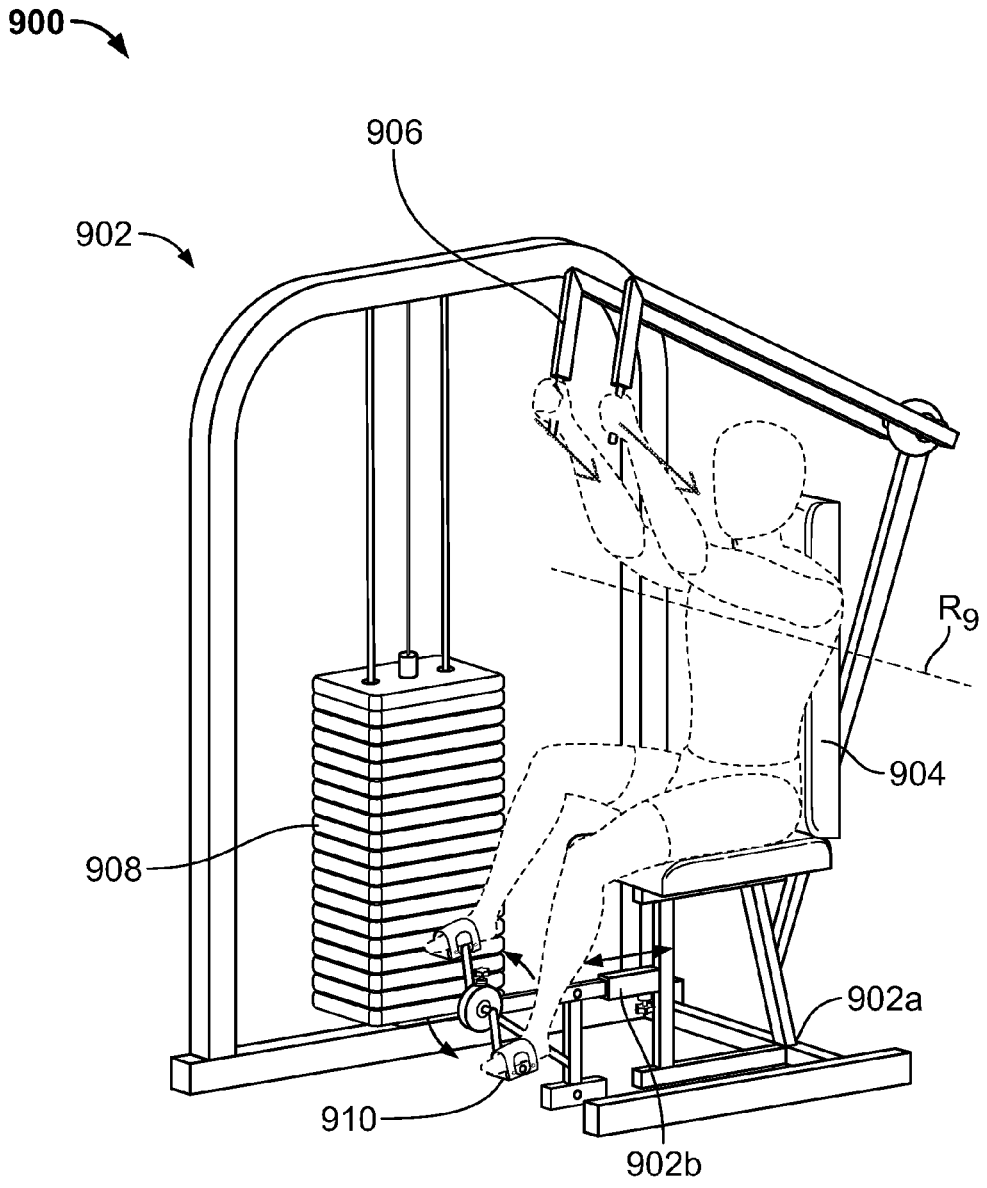
FIG. 9B is a perspective view of the physical exercise apparatus of FIG. 9A, being operated by a user.

Referring to FIG. 9B, a method of physical exercise training may comprise providing the physical exercise apparatus 900 and positioning at least a portion of a body of a user in an at least partially supine position on the seat 904. The user may access the pair of movable arms 906 with the user in the at least partially supine position. The user may also place his or her feet on the cycling foot pedals 910 with the user in the at least partially supine position. In embodiments, a user may access a portion of the movable arms 906 such that the user's arms are disposed overhead so that an angle of between and including about 75 degrees and about 85 degrees, such as 80 degrees, is formed between the user's humerus and a reference line $R_9$ formed by the user's clavicle. In embodiments, the user's arms may have an initial position so that a different angle is formed between the user's humerus and the reference line $R_9$.

Figure 9C:
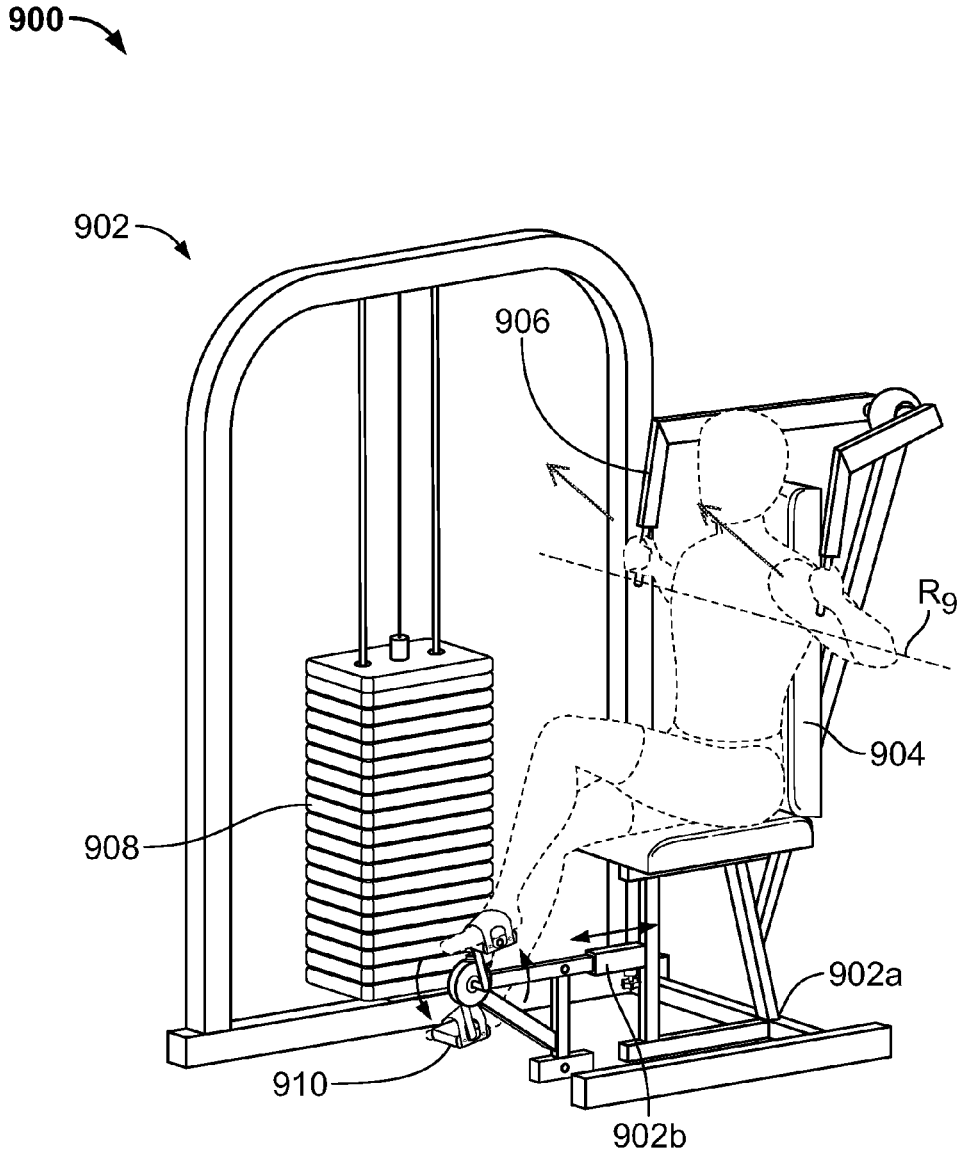
FIG. 9C is a perspective view of the physical exercise apparatus of FIG. 9A, being operated by a user.
Figure 9D:
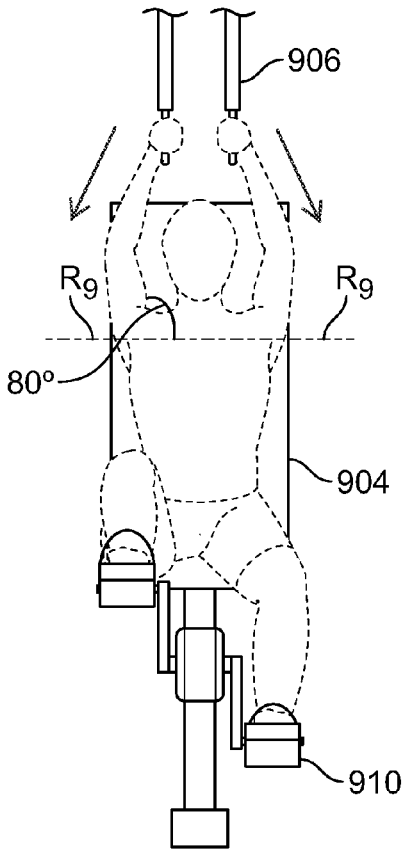
FIG. 9D is a front view of a portion of the physical exercise apparatus of FIG. 9A, with a user disposed thereon.
Figure 9E:
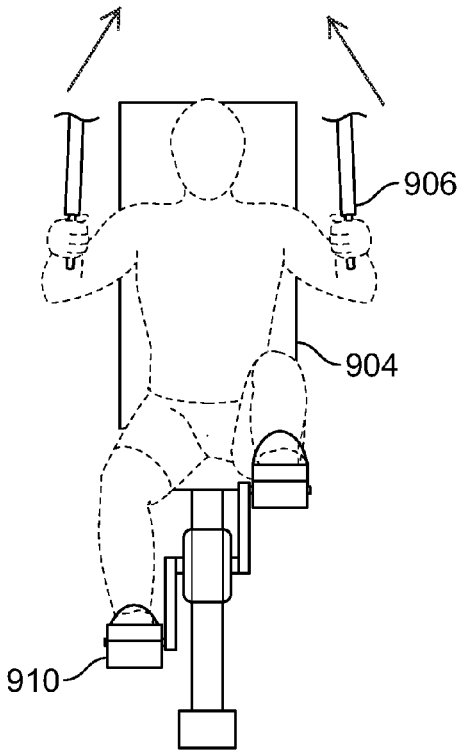
FIG. 9E is a front view of a portion of the physical exercise apparatus of FIG. 9A, being operated by a user.

With reference to FIGS. 9C, 9D, and 9E, the user may then simultaneously move the movable arms 906 while independently cycling the cycling foot pedals 910 with the user in the at least partially supine position. In embodiments, the user may continuously cycle the pair of cycling foot pedals 910 during movement of the pair of movable arms 906. In embodiments, the user may move the pair movable arms 906 so that the pair of movable arms 906 are pulled downwardly toward and/or laterally outwardly from the seat 904 to perform shoulder retraction exercises. In embodiments, the user's arms may have a position after pulling the pair of movable arms 906 so that an angle of between about −15 degrees and about −25 degrees, such as −20 degrees, is formed between the user's humerus and the reference line $R_9$. In embodiments, the user's arms may have an extended position at a different angle formed between the user's humerus and the reference line $R_9$. Downward pulling of the movable arms 906 by the user may cause a selected portion 908*a* of the resistance load 908 to linearly move along the frame 902. An unselected portion 908*b* of the resistance load 908 may remain stationary along the frame 902. In embodiments, a selected portion 908*a* of the resistance load 908 may comprise the entire resistance load 908.

The cycling motion of the user's lower body may provide distraction so that the user is positioned in a manner to perform shoulder retractions with the pair of movable arms 906 so that a substantially even resistive loading is received by, for example, the user's levator scapulae muscles, middle trapezus muscles, and/or rhomboid muscles. In this manner, a resistive loading may be transferred to the user's levator scapulae muscles, middle trapezus muscles, and/or rhomboid muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

Figure 10A:
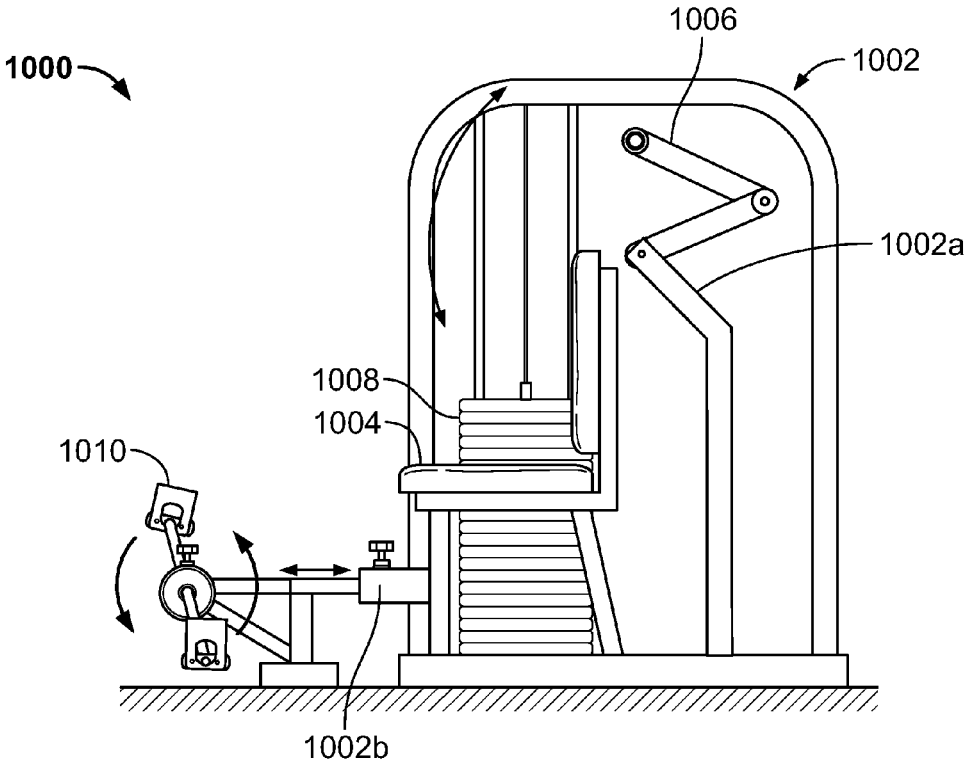
FIG. 10A is a side view of a physical exercise apparatus according to an exemplary embodiment of the present disclosure.

FIG. 10A shows a physical exercise apparatus, generally designated by reference number 1000, according to an exemplary embodiment of the present disclosure. Physical exercise apparatus 1000 may include a frame 1002 having a first portion 1002*a* and a second portion 1002*b*. A seat 1004 may be supported by the frame 1002 and configured to support a user in an at least partially supine position.

A pair of independently movable arms 1006 may be movably coupled to the first portion 1002*a* of the frame 1002. The pair of movable arms 1006 may be configured as a pair of handlebars that are movably coupled to the frame 1002. In this manner, each of movable arms 1006 may be independently movable from one another, for example, by each of a user's hands and arms. In embodiments, the pair of movable arms 1006 may be configured as, for example, a single angled handlebar configured for use with both of a user's hands and arms simultaneously. The pair of movable arms 1006 may be configured to be accessed near or behind a user's head and extended overhead so that the user can perform, for example, triceps extensions with the pair of movable arms 1006. The first portion 1002*a* of the frame 1002 may be substantially stationary with respect to the seat 1004 so that the pair of movable arms 1006 may be movably coupled to a substantially stationary coupling point on the frame 1002. The pair of movable arms 1006 may be coupled with a linearly movable resistance load 1008. In embodiments, resistance load 1008 may be an adjustable weight stack. In embodiments, each of the pair of movable arms 1006 may be coupled with a separate linearly movable resistance load.

A pair of cycling foot pedals 1010 may be coupled to the second portion 1002*b* of frame 1002 and independently movable from the pair of movable arms 1010 so that the user can cycle the pair of cycling foot pedals 1012 while separately moving the pair of arms 1006 to perform triceps extensions. The second portion 1002*b* of the frame 1002 may be substantially stationary with respect to the seat 1004 so that the cycling foot pedals 1010 may be rotatably attached to the frame 1002 and movable about a substantially stationary rotation axis. The pair of cycling foot pedals 1010 may be positioned in front of the seat 1004 and configured for engagement by a portion of a user's lower body.

Figure 10B:
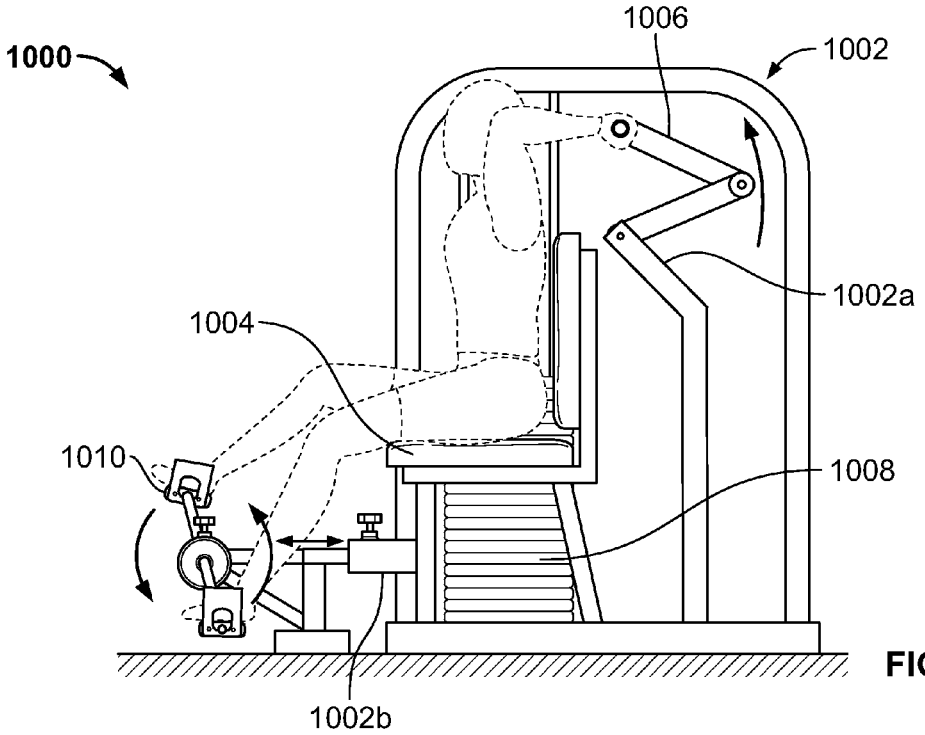
FIG. 10B is a side view of the physical exercise apparatus of FIG. 10A, with a user disposed thereon.

Referring to FIG. 10B, a method of physical exercise training may comprise providing the physical exercise apparatus 1000 and positioning at least a portion of a body of a user in an at least partially supine position on the seat 1004. The user may access the pair of movable arms 1006 in the at least partially supine position. The user may also place his or her feet on the cycling foot pedals 1010 in the at least partially supine position.

Figure 10C:
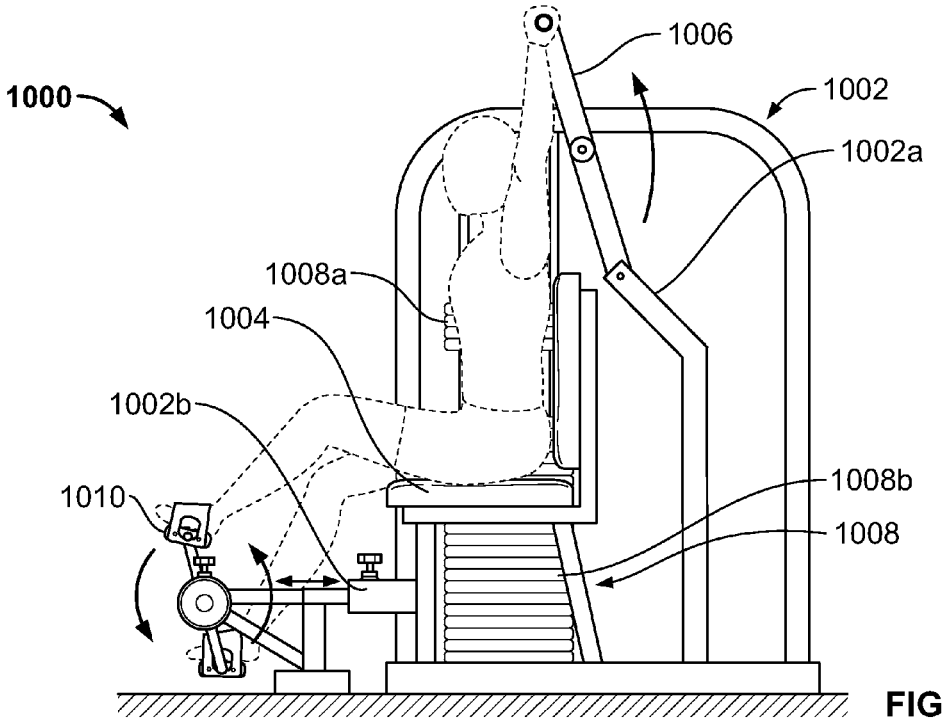
FIG. 10C is a side view of the physical exercise apparatus of FIG. 10A, being operated by a user.

With reference to FIG. 10C, the user may then simultaneously move the movable arms 1006 overhead while independently cycling the cycling foot pedals 1010 with the user in the at least partially supine position. In embodiments, the user may continuously cycle the pair of cycling foot pedals 1010 during movement of the pair of movable arms 1006. The user may move the pair movable arms 1006 so that the movable arms 1006 are extended overhead and/or generally upwardly and away from the seat 1004 to perform triceps extensions. Overhead extension of the movable arms 1006 by the user may cause a selected portion 1008*a* of the resistance load 1008 to linearly move along the frame 1002. An unselected portion 1008*b* of the resistance load 1008 may remain stationary along the frame 1002. In embodiments, a selected portion 1008*a* of the resistance load 1008 may comprise the entire resistance load 1008.

The cycling motion of the user's lower body may provide distraction so that the user is positioned in a manner to perform extensions with the pair of movable arms 1006 so that a substantially even resistive loading is received by, for example, the user's triceps muscles. In this manner, a resistive loading may be transferred to the user's triceps muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

It will be understood that the presently-disclosed physical exercise apparatuses may be varied to suit the particular needs of user. In embodiments, components of a physical exercise apparatus, such as a seat, one or more movable arms, and/or a pair of cycling foot pedals, to name a few, may be monolithically formed with or separable from a frame in a manner similar to or different from physical exercise apparatus 100 described above. In embodiments, a frame may be an integrally formed member or may be formed of one or more frame components. In embodiments, a physical exercise equipment apparatus may include, for example, linear and/or curvate frame portions, one, a pair, or more than two movable arms, and/or variable seat configurations, to name a few. In embodiments, an exercise equipment apparatus may comprise a pair of arms symmetrically spaced about an axial midline of a seat. In embodiments, a movable arm may comprise a substantially rigid member. In embodiments, a frame may be attached to a surface or otherwise be configured to have a generally stationary configuration. In embodiments, a frame may include one or more members to provide mobility to the frame, such as a wheel or sliding surface pad.

In the exemplary embodiments of the present disclosure, a seat may be one of a bench, chair, or stool, to name a few, and combinations thereof. In embodiments, a seat may include a back support and a lower body support. In embodiments, a back support may be disposed at an angle with respect to the lower body support, for example, an angle of about 40 degrees with respect to a reference line drawn through the lower body support. In embodiments, a back support may be disposed at a fixed angle with respect to a lower body support. In embodiments, a back support may be adjustable, such movably coupled, with respect to a lower body support such that the back support may be moved through a range of angles with respect to the lower body support. In embodiments, a back support may be disposed at a fixed or adjustable angle of, for example, between and including about 180 degrees and about 90 degrees with respect to a seat support.

In the exemplary embodiments of the present disclosure, an exercise equipment apparatus may comprise a single movable arm or multiple movable arms that are each coupled with a respective resistance load. In embodiments, multiple movable arms may be configured to move independently or in concert.

In the exemplary embodiments of the present disclosure, one or more foot pedals may have any desirable configuration, for example, flat, grooved, ergonomically-shaped and/or incorporating a user retention member such as a strap, clip, or stirrup, to name a few.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A physical exercise apparatus, comprising:

(a) a frame;

(b) a seat supported by the frame and configured to support a user in a seated position;

(c) a pair of movable arms movably coupled to a first portion of the frame and coupled with a common, linearly movable resistance load and configured for the user to perform a target exercise comprising an upper body, weight lifting exercise with the resistance load that is targeted to developing deltoid muscles in the user's upper body while the user is in the seated position, wherein the weight of the user is not used as the resistance load, and wherein the first portion of the frame is stationary with respect to the seat, wherein the pair of movable arms thorax, and wherein the pair of movable arms are configured to be pressed upward by the user, and wherein the pair of movable arms are configured to approach an apex above the user's head while the user is in the seated position such that the pair of movable arms move towards each other as the pair of movable arms are pressed upward, and the pair of movable arms come into contact with each other above the user's head along an axial midline of the user's body while the user is in the seated position; and so that in an initial position of each of the user's arms, when initiating the weight lifting exercise, an angle of between 70 and 80 degrees is formed between the user's humerus and a reference line formed by the user's lateral thorax, and in an extended position of each of the user's arms, an angle of between 168 and 178 degrees is formed between the user's humerus and the reference line formed by the user's lateral thorax; and, (d) a pair of cycling foot pedals, which are not connected to the resistance load in a manner that enables the resistance load to provide resistance to the pair of cycling foot pedals, and are configured to be movably coupled to a second portion of the frame and independently movable from the pair of movable arms so that the user is able to cycle the pair of cycling foot pedals with the user's feet as a distraction exercise, while the user is simultaneously performing the target exercise by separately engaging the pair of movable arms in the seated position, to inhibit the user from using the muscles of the lower body to leverage the user's deltoid muscles of the upper body in the target exercise.

2. The physical exercise apparatus of claim 1, wherein the pair of movable arms are configured to be lifted upwardly with respect to the seat.

3. The physical exercise apparatus of claim 1, wherein the pair of movable arms are configured to diverge with respect to the axial midline of the user's body.

4. The physical exercise apparatus of claim 1, wherein the pair of movable arms are configured to provide resistance to a portion of the user's upper body.

5. The physical exercise apparatus of claim 1, wherein the pair of cycling foot pedals are configured to provide distraction to a portion of the user's lower body.

6. A method of physical exercise training comprising:

(a) providing a physical exercise apparatus, comprising:

a frame;

a seat supported by the frame and configured to support a user in a seated position;

a pair of movable arms movably coupled to a first portion of the frame and coupled with a common, linearly movable resistance load and configured for the user to perform a target exercise comprising an upper body, weight lifting exercise with the resistance load that is targeted to developing deltoid muscles in the user's upper body while the user is in the seated position, wherein the weight of the user is not used as the resistance load, and wherein the first portion of the frame is stationary with respect to the seat, wherein the pair of movable arms are further configured so that in an initial position of each of the user's arms, when initiating the weight lifting exercise, an angle of between 70 and 80 degrees is formed between the user's humerus and a reference line formed by the user's lateral thorax, and in an extended position of each of the user's arms, an angle of between 168 and 178 degrees is formed between the user's humerus and the reference line formed by the user's lateral thorax; and wherein the pair of movable arms are configured to be pressed upward by the user, and wherein the pair of movable arms are configured to approach an apex above the user's head while the user is in the seated position such that the pair of movable arms move towards each other as the pair of movable arms are pressed upward, and the pair of movable arms come into contact with each other above the user's head along an axial midline of the user's body while the user is in the seated position; and a pair of cycling foot pedals, which are not connected to the resistance load in a manner that enables the resistance load to provide resistance to the pair of cycling foot pedals, and are configured to be movably coupled to a second portion of the frame and independently movable from the pair of movable arms so that the user can cycle the pair of cycling foot pedals with the user's feet as a distraction exercise, while the user is simultaneously performing the target exercise by separately engaging the pair of movable arms in the seated position, to inhibit the user from using the muscles of the lower body to leverage the user's deltoid muscles of the upper body in the target exercise;

(b) positioning at least a portion of the body of the user in the seated position on the seat;

(c) accessing by the user the pair of movable arms with the user in the seated position; and (d) simultaneously engaging by the user the pair of movable arms to exercise a portion of the anatomy of the user and independently cycling by the user the pair of cycling foot pedals using a pair of feet of the user while the user is in the seated position.

7. The method of claim 6, wherein engaging by the user the pair of movable arms includes lifting the pair of movable arms upwardly with respect to the seat.

8. The physical exercise apparatus of claim 1, wherein the seat comprises a back support and a seat support.

9. The physical exercise apparatus of claim 1, wherein the configuration of the pair of cycling foot pedals for the cycling as the distraction exercise enables the user to more deeply engage the deltoid muscles of the user's upper body with the target exercise for which the pair of movable arms are configured.

10. The physical exercise apparatus of claim 1, wherein the configuration of the pair of cycling foot pedals for the cycling as the distraction exercise facilitates an even resistive loading of weight across an axial midline of the user's upper body with the target exercise for which the pair of movable arms are configured.

11. The physical exercise apparatus of claim 1, wherein the target exercise and the distracting exercise are substantially biomechanically isolated from one another.

* * * * *